US012290217B2

(12) United States Patent
Welch et al.

(10) Patent No.: US 12,290,217 B2
(45) Date of Patent: May 6, 2025

(54) SHOWER BASE SYSTEM

(71) Applicant: Welch Tile & Marble Co., Kent City, MI (US)

(72) Inventors: Daniel J. Welch, Kent City, MI (US); Steven Coates, Allendale, MI (US)

(73) Assignee: Welch Tile & Marble Co., Kent City, MI (US)

( * ) Notice: Subject to any disclaimer, the term of this patent is extended or adjusted under 35 U.S.C. 154(b) by 75 days.

(21) Appl. No.: 18/188,142

(22) Filed: Mar. 22, 2023

(65) Prior Publication Data

US 2023/0218124 A1 Jul. 13, 2023

Related U.S. Application Data

(63) Continuation of application No. 17/019,087, filed on Sep. 11, 2020, now Pat. No. 11,617,476.

(60) Provisional application No. 62/900,305, filed on Sep. 13, 2019, provisional application No. 62/904,414, filed on Sep. 23, 2019.

(51) Int. Cl.
*A47K 3/40* (2006.01)
*E03F 5/04* (2006.01)

(52) U.S. Cl.
CPC ..... *A47K 3/40* (2013.01); *E03F 5/0408* (2013.01)

(58) Field of Classification Search
CPC ..... A47K 3/40; E03F 5/0408
See application file for complete search history.

(56) References Cited

U.S. PATENT DOCUMENTS 2,239,969 A 4/1941 Morthland
2,962,405 A 11/1960 Morthland
5,124,031 A * 6/1992 Dallmer ..... E03F 5/0407 210/232
5,845,347 A 12/1998 Young
6,886,190 B2 * 5/2005 Tompane ..... E03F 5/06 4/612
8,181,288 B1 5/2012 Davis, Jr.
8,230,535 B2 7/2012 Kik, Sr. et al.
8,918,926 B1 12/2014 Herring
9,107,545 B1 8/2015 Herring
(Continued)

FOREIGN PATENT DOCUMENTS

AU 629113 B2 9/1992
EP 1783285 A1 * 5/2007 ..... E03F 5/0408
(Continued)

OTHER PUBLICATIONS

Machine Translation KR 0138292 (Year: 2024).*
(Continued)

*Primary Examiner* — Janie M Loeppke
(74) *Attorney, Agent, or Firm* — Miller Johnson

(57) ABSTRACT

A pre-installation method for a shower base includes obtaining a combination of layers forming the shower base where the combination of layers includes a waterproof membrane mounting surface and a subfloor facing surface opposite the waterproof membrane mounting surface. The method also includes adhering, in a remote location from an installation site, a waterproof membrane to the combination of layers forming the shower base. The method further includes water testing, in the remote location, the shower base with the adhered waterproof membrane.

21 Claims, 21 Drawing Sheets

(56) References Cited

U.S. PATENT DOCUMENTS

| | | | | |
|---|---|---|---|---|
| 9,307,869 | B2 | 4/2016 | DeJesus et al. | |
| 9,775,472 | B1 | 10/2017 | Herring | |
| 10,028,623 | B1 | 7/2018 | Smith et al. | |
| 10,182,684 | B2 | 1/2019 | Davis, Jr. | |
| 10,794,052 | B2 * | 10/2020 | McLeod | E03F 5/06 |
| 2008/0276364 | A1 | 11/2008 | Barro et al. | |
| 2016/0073831 | A1 | 3/2016 | Wedi | |
| 2016/0265203 | A1 | 9/2016 | Knapp et al. | |
| 2018/0110379 | A1 | 4/2018 | Wadaga | |
| 2020/0029747 | A1 | 1/2020 | Wadaga | |

FOREIGN PATENT DOCUMENTS

| | | | | |
|---|---|---|---|---|
| EP | 2460944 | A1 | 6/2012 | |
| KR | 0138292 | Y1 * | 4/1999 | E03F 5/0407 |

OTHER PUBLICATIONS

Extended European Search Report for EP20863147.3 dated Jan. 18, 2024, 10 pages.

International Search Report from PCT application PCT/US20/50562, dated Feb. 4, 2022.

Written Opinion of the International Searching Authority from PCT application PCT/US20/50562, dated Feb. 4, 2022.

International Preliminary Report on Patentability from PCT application PCT/US20/50562, dated Mar. 15, 2022.

Non-Final Office Action for U.S. Appl. No. 17/019,087, dated Jan. 1, 2022.

Final Office Action for U.S. Appl. No. 17/019,087, dated Jul. 1, 2022.

Notice of Allowance for U.S. Appl. No. 17/019,087, dated Jan. 10, 2023.

* cited by examiner

SHOWER BASE SYSTEM

CROSS REFERENCE TO RELATED APPLICATIONS

This U.S. nonprovisional patent application claims priority under 35 U.S.C. § 120 to U.S. Nonprovisional application Ser. No. 17/019,087, filed on Sep. 11, 2020, which claims priority under 35 U.S.C. § 119(e) to U.S. Provisional Application 62/900,305, filed on Sep. 13, 2019 and U.S. Provisional Application 62/904,414, filed on Sep. 23, 2019. The disclosures of these prior applications are considered part of the disclosure of this application and are hereby incorporated by reference in their entireties.

TECHNICAL FIELD

This disclosure relates to an assembled shower base.

SUMMARY

One aspect of the disclosure provides a portable shower base assembly. The portable shower base assembly includes a spacer layer, a curb, a waterproof membrane, and a drain. The spacer layer includes a base-layer mounting surface, a waterproof membrane mounting surface opposite the base-layer mounting surface, and a side surface extending from the base-layer mounting surface to the waterproof membrane mounting surface. The curb is adhered to and extends along the side surface of the spacer layer from the base-layer mounting surface to a height above the waterproof membrane mounting surface. Here, the height is defined as a distance from the waterproof membrane mounting surface to a top surface of the curb. The curb includes at least one end. The waterproof membrane is adhered to and covers the waterproof membrane mounting surface of the spacer layer such that the waterproof membrane (i) extends along the height of the curb, (ii) covers the top surface of the curb, and (iii) covers a side of the curb opposite the side surface of the spacer layer. The drain includes a top drain surface and a bottom drain surface opposite the top drain surface. The drain is inserted within a cavity of the spacer layer such that the bottom drain surface is flush with the base-layer mounting surface, and wherein the drain forms a watertight seal with the waterproof membrane. The waterproof membrane mounting surface slopes towards the drain. In some examples, a corner of the waterproof membrane includes a flap where the flap reinforces the waterproof membrane that covers the top surface of the curb at the at least one end of the curb. The flap may tuck under a portion of the waterproof membrane that wraps around the top surface of the curb to the side of the curb.

Another aspect of the disclosure provides a portable shower base assembly. The portable shower base assembly includes a spacer layer, a curb, a waterproof membrane, and a drain. The spacer layer includes a base-layer mounting surface and a waterproof membrane mounting surface opposite the base-layer mounting surface. The waterproof membrane adheres to and at least partially covers the waterproof membrane mounting surface of the spacer layer. The curb is positioned along an edge of the spacer layer and extends a length of the spacer layer. The curb is adhered to a top surface of the waterproof membrane opposite the waterproof membrane mounting surface of the spacer layer. The curb extends a height above the waterproof membrane mounting surface where the height is defined as a distance from the waterproof membrane mounting surface to a top surface of the curb. The curb includes at least one end. The drain includes a top drain surface and a bottom drain surface opposite the top drain surface. The drain is inserted within a cavity of the spacer layer such that the bottom drain surface is flush with the base-layer mounting surface, and wherein the drain forms a watertight seal with the waterproof membrane. A portion of the waterproof membrane is additionally adhered to the curb such that the portion of the waterproof membrane (i) extends the height of the curb along an outer side surface of the curb, the outer side surface of the curb coplanar with the edge of the spacer layer, (ii) covers the top surface of the curb, and (iii) covers a side of the curb opposite the outer side surface of the curb. The waterproof membrane mounting surface slopes towards the drain. In some examples, the portion of the waterproof membrane covering the side of the curb opposite the outer side surface of the curb secures to a second portion of the waterproof membrane adhered to the waterproof membrane mounting surface of the spacer layer sloping towards the drain.

Implementations of either disclosure for the portable shower base assembly may include one or more of the following optional features. In some implementations, the waterproof membrane entirely covers the side of the curb opposite the side surface of the spacer layer. In some examples, the sloped surface of the spacer layer corresponds to one of a plurality of sloped surfaces that converge towards the drain. The spacer layer may be a foam spacer layer. The waterproof membrane may be a continuous sheet of material. In some configurations, the portable shower base assembly further includes a layer of tile adhered to the waterproof membrane. The tile layer may be adhered to and covering the portion of the waterproof membrane that covers the top surface of the curb, the portion of the waterproof membrane covering the side of the curb opposite the outer side surface of the curb, and the waterproof membrane covering the waterproof membrane mounting surface of the spacer layer. In some examples, the portable shower base assembly also includes a drain adapter seated in a recess of the drain where the drain adapter is configured to rotate within the recess of the drain to at least partially align an opening in the drain adapter with a plumbing connection for the drain of the portable shower base assembly. The opening of the drain adapter may be defined by a center point offset from an overall center point of the drain adapter. The waterproof membrane may form a folded corner at the at least one end of the curb. In some examples, the drain further includes a clamping collar where the clamping collar of the drain forms the watertight seal by clamping a portion of the waterproof membrane that overlaps the drain against the top surface of the drain.

Another aspect of the disclosure provides a pre-installation method. The method includes obtaining a combination of layers forming a shower base where the combination of layers includes a waterproof membrane mounting surface and a subfloor facing surface opposite the waterproof membrane mounting surface. The method also includes adhering, in a remote location from an installation site, a waterproof membrane to the combination of layers forming the shower base. The method further includes water testing, in the remote location, the shower base with the adhered waterproof membrane. In some examples, the method also includes indicating that the shower base with the adhered waterproof membrane passes the water test prior to installation. In some implementations, adhering the waterproof membrane further includes cutting a tab into a corner of the waterproof membrane; and forming a reinforced fold in the corner of the waterproof membrane by overlapping the tab with another portion of the waterproof membrane. In some configurations, the method additionally includes adhering, in the remote location, a curb positioned along an edge of shower base layer extending a length of the shower base. Here, adhering the waterproof membrane to the combination of layers forming the shower base includes adhering the waterproof membrane to the curb such that a portion of the waterproof membrane (i) extends a height of the curb along an outer side surface of the curb, the outer side surface of the curb coplanar with the edge of the shower base, (ii) covers atop surface of the curb, and (iii) covers a side of the curb opposite the outer side surface of the curb. In some examples, the method further includes securing, in the remote location, the portion of the waterproof membrane covering the side of the curb opposite the outer side surface of the curb to a second portion of the waterproof membrane adhered to the waterproof membrane mounting surface of the shower base. Optionally, the method also includes applying a layer of tile to a top surface of the shower base.

In yet another aspect of the disclosure, the disclosure provides a method of installation. The method of installation includes obtaining a combination of layers forming a shower base where the combination of layers includes a waterproof membrane mounting surface and a subfloor facing surface opposite the waterproof membrane mounting surface. The method also includes connecting a drain plumbing pipe to a drain of the shower base. The method further includes adhering the shower base to a subfloor within a shower area at an installation site. The method additionally includes securing a waterproof membrane of the shower base to a structure within the shower area. In some examples, the method further includes applying a layer of tile to a top surface of the shower base. In some implementations, connecting the drain plumbing pipe to the drain of the shower base includes inserting a drain adapter into the drain of the shower base and rotating the drain adapter within the drain of the shower base until an opening in the drain adapter at least partially aligns with the drain plumbing pipe.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

BACKGROUND

Custom-tiled showers are an important installation for a tile setter. Yet compared to other more standard methods, a custom installation method may expose the tile setter to increased liability and/or safety concerns. In other words, when a custom-tiled shower is not installed properly, the tile setter may be responsible for potential damage and/or shower-related accidents. In some cases, damage due to poor installations may be particularly harmful since flaws or errors may cause water damage that may compromise the structural integrity of a shower area. To help avoid potential pitfalls during installation, trade books and/or trade manuals, such as The Tile Council of North America (TCNA) handbook, describe tiled shower base constructions along with common shower configurations and shower receptor renovations. However, even with these guides, custom tile installations still continue to pose issues for tile setters or other tradesmen at jobs both large and small.

Manufactures have developed many shower products over the past decade or so that seek to provide cost savings or reduced skill solutions for site-built construction of shower receptors (e.g., a shower base). Traditionally, a shower base refers to a sheet membrane that is installed on a pre-sloped sub floor and that fastens directly to a clamping flange. The shower base area is then filled with a mortar bed to the desired height. Once the mortar cures, tile is installed on the mortar bed and grouted using ANSI standards. This system generally follows B-415 ("Bonded waterproof membrane & integrated bonding flange") of the TCNA handbook.

DETAILED DESCRIPTION

Figure 1A:
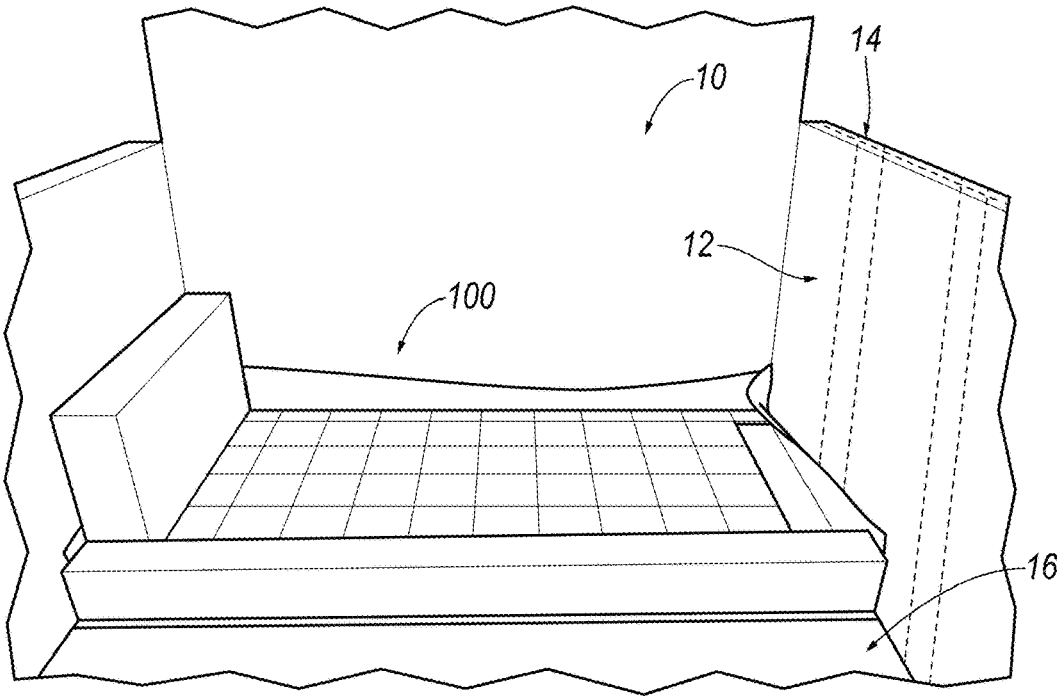
FIG. 1A is a perspective view of an example shower base with tile.
Figure 1B:
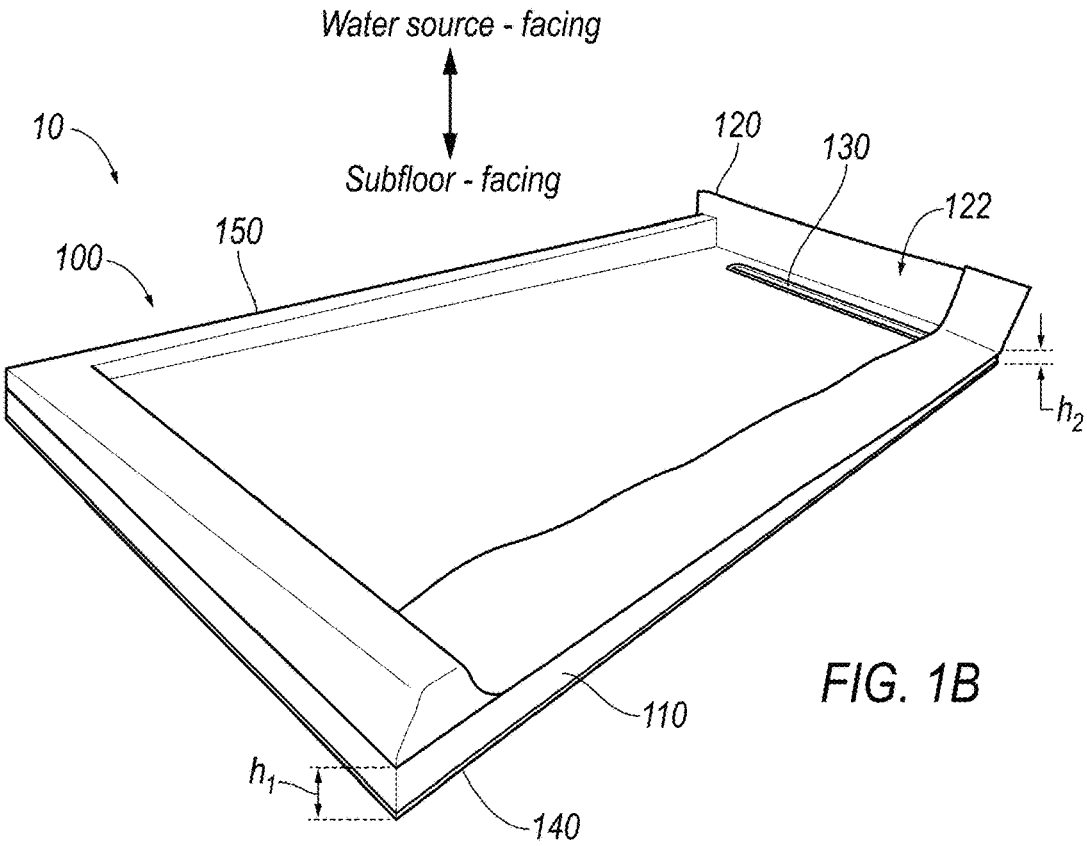
FIG. 1B is a perspective view of an example shower base without tile.

In order to overcome some inherent issues with traditional designs, a shower environment 10 shown in FIGS. 1A and 1B includes an inventive shower base system 100 (also referred to simply as the shower base 100). Generally speaking, for a traditional shower base, the shower base is assembled "on site" during installation. In other words, an installer typically assembles and installs the shower base together layer-by-layer in the location where the shower base will be permanently affixed to a subfloor to form a usable shower area. The shower base is considered "permanently affixed" when the shower base is secured to plumbing for water drainage as well as bonded to the subfloor; therefore, the shower base is unable to move (unless a force would be applied to destroy the bond between the shower base and the subfloor). In contrast to this traditional "on-site" assembly and installation process, the shower base 100 disclosed herein is assembled in an "off-site" location prior to installation; meaning a location that is remote (i.e., a remote location) from the job-site or on-site location. In other words, the assembly of the shower base 100 occurs pre-installation at a location different than where the shower base 100 will be installed (e.g., the pre-installation location is a manufacturing facility or other controlled assembly environment). Here, "pre-installation" means that the process occurs prior to the shower base 100 being installed or permanently affixed to form a usable shower area. Stated differently, when the shower base 100 is being assembled off-site, it is not also being installed. With this approach, the shower base system 100 is designed to lessen the need for on-site labor and/or to improve the efficiency and quality of the shower base. For example, with the shower base system assembly occurring pre-installation (i.e., prior to installation), someone, such as a tile setter, may test and prove the construction of the components that form the shower base system 100 before installation. By testing the shower base system 100 before installation, someone like the installer may save time and/or potential headaches associated with water-testing during installation. For instance, when a traditional shower base is installed on-site, if the installed shower base fails leak-testing, the installer may have to redo some or all of the structure. If this were to occur on a large project (e.g., a commercial multi-unit building, such as a hotel, office building, motel, etc.), this rework may prove costly, not only on an individual basis, but potentially have greater impact on a larger scale. For instance, reworking the shower base structure could disrupt a construction schedule especially where multiple shower bases need to be installed during a particular construction window/timeline to ensure timeliness for the overall project. To overcome such issues, the shower base 100 may be water tested per current Uniform Plumbing Code (UPC) and/or International Plumbing Code (IPC) prior to arriving on a job-site for installation. In some configurations, the shower base 100 receives an indication (e.g., a tag, a stamp, a marking, or some other indicator) that the shower base 100 passes the water test (e.g., a water test accreditation) prior to installation (e.g., being transferred to the job-site). For example, the indication includes a date, a time, and/or an inspector name/initials.

The shower base 100 may provide several installation advantages. In some examples, the shower base 100 is ready-to-tile, with optional pre-tile installation of stone and/or tile installed and grouted per design specifications. By assembling the shower base 100 pre-installation off-site, even complex, multi-unit jobs may have more intricate tile and/or stone options because the shower base 100 is assembled prior to the job-site; giving the assembler more time (e.g., for customization). This allows jobs that may traditionally have been limited to more basic tile options, or not capable of tile options, to have almost infinite options like a custom and personal home installation. In other words, the assembler does not suffer from job-site schedule compression. Additionally or alternatively, the shower base 100 may allow for easy application of tile over tile to remodel the shower base 100 as colors and/or trends change with time.

In some implementations, the shower base 100 is constructed for a variety of installation methods. For example, the assembled shower base 100 is installed prior to installation of a backer board 12 such that the shower base 100 fastens to framing structure 14 in the shower area (e.g., to framing studs). This may be useful for applications that specify a vapor barrier. In other installations, the installer installs the shower base 100 after the backer board 12 and secures the shower base 100 to the backer board 12. For example, a waterproof membrane 120 (e.g., that meets the American National Standards Institute (ANSI) 118.10 standard) of the shower base 100 is secured to the backer board 12 (e.g., as shown in FIG. 1A) or the framing structure 14. For instance, FIG. 1A depicts that the shower base 100 is surrounded on three sides and will be secured to the backer board 12. Here, the fourth side of the shower base 100 is an entry point for a user of the shower base 100. Moreover, FIG. 1A depicts the backer board 12 secured to a wooden framing structure 14. For an application with a vapor barrier, the waterproof membrane of the shower base 100 (e.g., shown overhanging the shower base 100) would wrap underneath the backer board 12 and be secured behind the backer board 12 to the framing structure 14.

Referring further to FIG. 1A, the shower base 100 is shown disposed on a subfloor 16 (e.g., the subfloor 16 is shown extending outward from the fourth side beneath the shower base 100). In other words, the shower base 100 may be adhered to or secured to the subfloor 16. This means that the entire shower base 100 is independent of the subfloor 16. With each layer being independent of the subfloor 16, the installer of the shower base 100 may easily install the shower base 100 on top of the subfloor 16 with minimal modifications to the subfloor 16 itself.

Although some examples below refer to a backer layer, the backer layer is a layer of the shower base 100 and is not a layer of the subfloor 16 (and is not synonymous with the subfloor 16). Various layers of the shower base 100 may be referenced by spatial relationships in the shower environment 10. In the shower environment 10, the shower base 100 sits between the subfloor 16 and a water source (e.g., a faucet or a showerhead—not shown). Due to this relationship, various surfaces of the layers of the shower base 100 may be referred to herein either as facing the water source (i.e., which is above the shower base 100) or facing the subfloor 16 (i.e., which is below the shower base 100).

FIGS. 1A-1E are examples of the shower base 100. Here, FIG. 1A depicts an embodiment of the shower base 100 that includes a layer of tile that is adhered and grouted in place while FIG. 1B shows an shower base 100 before the application of the layer of tile. An installer may receive either version, depending on the particular installer and the time available for the on-site installation. In other words, the shower base 100 may leave the manufacturing facility as an assembled and tiled shower base 100 (e.g., as shown in FIG. 1A) or an assembled shower base 100 without tile (e.g., as shown in FIG. 1B).

Referring further to FIGS. 1A and 1B, the shower base 100 includes at least a spacer layer 110, a waterproof membrane 120, and a drain 130. In some examples, the spacer layer 110 is further supported by a backer layer 140 (e.g., shown in FIGS. 1C-1E and FIGS. 2A and 2B). In some implementations, the shower base 100 also includes one or more curbs 150 that form a perimeter wall around at least one or more sides of the shower base 100 (e.g., a side that is orthogonal to the spacer layer 110). Overall, based on its structure, the shower base 100 is capable of complying with tile installation methods and standards (e.g., ANSI A108.02 from the Tile Handbook of North America) and/or using some other sound versions, methods, and practices (e.g., following TCNA installation method B421).

Figure 1C:
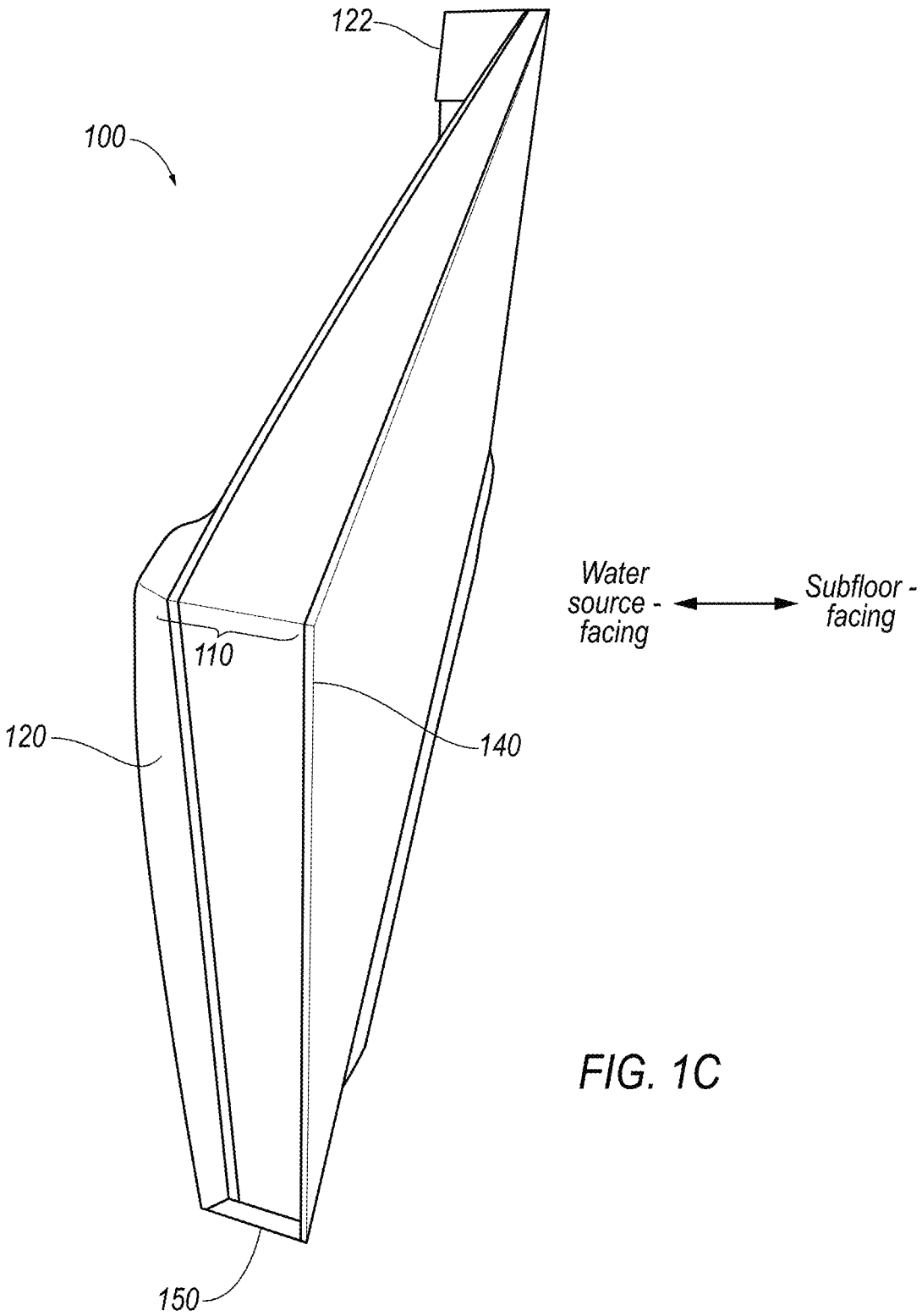
FIGS. 1C-1D are perspective views of the example shower base of FIG. 1B.

The spacer layer 110 generally serves as a support surface for the shower base 100. In one embodiment, the spacer layer 110 is sloped to guide water along a surface of the shower base 100 to the drain 130 (e.g., as shown in FIG. 1C). As a sloped layer, the spacer layer 110 may have a greater height $h_1$ at an end opposite the drain 130 while a lesser height $h_2$ at the drain end of the shower base 100 (e.g., FIG. 1B). In some examples, the shower base 100 only includes one slope (e.g., as shown in FIG. 1C). Yet in other examples, the shower base 100 (e.g., the spacer layer 110) is constructed with multiple slopes that converge at the drain 130. For example, slopes of the spacer layer 110 may radially extend toward the drain 130. In these examples, the multi-sloped spacer layer 110 may be constructed of multiple pieces where each piece includes its own pre-defined slope or a single continuous spacer layer 110 with sections cut to form a multi-sloped unitary spacer layer 110. As a pre-formed and/or a pre-cut spacer layer 110, the spacer layer 110 may ensure a repeatable and dependable pitch towards the drain 130. In other words, the off-site assembly process and construction of the shower base 100 ensures strict compliance with quality standards in the tile and plumbing industries.

The spacer layer 110 may be constructed of one or more layers of material. For instance, FIG. 1F depicts a first shower base 100, 100*a* with a single spacer layer 110 (e.g., shown as a foam layer 112) side-by-side with a second shower base 100, 100*b* having a spacer layer 110 with multiple layers (e.g., shown as a foam layer 112 and a load support layer 114). Referring further to FIGS. 1C-1E, 2A, and 2B, the spacer layer 110 includes more than one layer, such as a foam layer 112 and a load support layer 114. The foam layer 112 may be formed from any type of foam that supports a human load without collapsing. Some examples of foam include closed cell or open cell foam, such as polyurethane foam or polystyrene foam. For instance, shower bases 100 may be designed with a closed cell foam to increase the watertight functionality of the spacer layer 110 (or curb 150) or may be designed with an open cell foam from a cost approach or where other layers already ensure that the shower base 100 has preventative measures to avoid water leaks. In some examples, the load support layer 114 increases the load support of the foam layer 112. In some implementations, the load support layer 114 is a hollow-celled layer such that the layer 114 is constructed with a plurality of hollow cells divided by vertical walls extending from a top to a bottom of the load support layer 114 (e.g., extending between the foam spacer 112 to the waterproof membrane 120). In some configurations, the structure of the load support layer 114 is impact resistant to prevent denting or divots that may occur in the foam layer 112. To provide such impact resistance, the load support layer 114 may be constructed much like an I-beam where the vertical walls of the hollow cells form a webbing and a top and bottom surface form the top and bottom flange, respectively; thereby forming a sandwich panel. When the spacer layer 110 includes more than one layer (e.g., the foam layer 112 and the load support layer 114), the layers may be bonded together (e.g., laminated together). For example, the layers 112, 114 or the layers 112, 114, and 140 are adhered or welded together. When any of the layers of the shower base 100 are adhered together, the type of adhesive may vary, but generally the type of adhesive will account for the material that forms the layers being adhered together. For example, a hot melt adhesive may not be appropriate for a plastic-based layer that has a lower melting temperature because the hot melt adhesive may cause deformation of the layer (e.g., affecting drain flow or the fit of the shower base 100 in the shower area). In some examples, the cure time of the adhesive factors into the type of adhesive used between layers. The shower base 100 may be rather large and an adhesive with a lower cure time may be preferable, especially to construct multiple shower bases 100 with an efficient throughput rate. For example, the adhesive may be an aqueous (or moisture) cure adhesive that sets in less than an hour (e.g., 10-20 minutes), rather than a standard hot melt, epoxy, or cement mortar with longer set times (e.g., overnight or for 24 hours) in order to properly cure (e.g., completely cure).

The waterproof membrane 120 may be secured to the spacer layer 110 (e.g., it is adhered to the spacer layer 110). The waterproof membrane 120 generally refers to a material that serves as a barrier that is capable of preventing water from penetrating underneath the membrane 120 (e.g., preventing water from penetrating to the layers beneath the waterproof membrane 120 and/or the subfloor 16 in the shower area). In some examples, the waterproof membrane 120 is a sheet membrane (e.g., an ANSI 118.10—load bearing, bonded, waterproof membranes for thin-set ceramic tile and dimension stone installation sheet membrane) bonded to a water-source facing surface (e.g., a waterproof membrane mounting surface) of the spacer layer 110. In some configurations, the waterproof membrane 120 is a material that ranges from a thickness of 0.010" to 0.040" (e.g., shown in FIG. 2A as a 0.030" material). The waterproof membrane 120 may include a water-source-facing adhesive-promoting surface (e.g., shown as a felt-like or fibrous liner) such that the adhesive-promoting surface promotes a strong/reliable bond with an adhesive used to secure tile or stone (e.g., a thinset material).

In some implementations, the waterproof membrane 120 assumes a slope of the spacer layer 110 (i.e., due to its securement to the spacer layer 110). In these implementations, the waterproof membrane 120 may have a sloped portion and non-sloped portion. In other words, the sloped portion of the waterproof membrane 120 may promote water to drain towards a drain (e.g., the drain 130) while the non-sloped portion is relatively flat or does not promote water to towards the drain. For instance, the shower base 100 may include an area that may receive a shower bench or other built-in structure for the shower area. Here, in this area, the spacer layer 110 and/or the waterproof membrane 120 may be relatively flat (e.g., on a plane with the subfloor 16) in order to receive the shower bench or other built-in structure. Outside this area on the shower base 100, the spacer layer 110 and/or the waterproof membrane 120 may include one or more slopes towards the drain. In this scenario, an installer may install the bench or other structure on the flat area of the shower base 100 (e.g., on the non-sloped portion of the waterproof membrane 120 and/or spacer layer 110) with needing to shim or otherwise account for a slope in that area.

In some examples, the waterproof membrane 120 is a continuous sheet of material that is secured to (e.g., laminated to) portions of the shower base 100. Furthermore, the waterproof membrane 120 may include overhanging portions 122 (also referred to as upturn portions) that are sized and configured such that the waterproof membrane 120 may be secured to the structure surrounding the shower base 100 (e.g., the backer board 12 or the framing structure 14). For instance, the overhanging portions 122 are sized and configured to be folded and/or fastened to meet plumbing industry requirements specifying that some form of waterproofing is required to a height of 3" above the curb 150. For example, when the shower base 100 includes one or more curbs 150, the waterproof membrane 120 is wrapped around and fastened to the one or more curbs 150 (e.g., as shown in FIGS. 4B-4I). When wrapping and fastening the waterproof membrane 120 to the one or more curbs 150, one or more flaps of material, such as overhanging portions 122, may extend beyond the curb 150. These one or more flaps of material may be bonded to a floor surface adjacent the shower base 100 (e.g., the subfloor 16) enabling a watertight zone around the shower base 100 (e.g., per IPC and UPC watertight standards). For instance, these one or more flaps of material may form an underlayment for tiling or other flooring adjacent the shower base 100. In some examples, a flap of material extends along an entire length of the curb 150. In some configurations, when there are not one or more curbs 150 on a particular side of the shower base 100, the waterproof membrane 120 may still include overhanging portions 122 to provide the same watertight option to the area adjacent the shower base 100 at that particular side.

As shown in FIGS. 1A-1D, 2B, 2C, 3A, and 3B, the shower base 100 may include a drain 130. In some examples, the drain 130 is a low profile drain 130 such that a top surface of the drain 130 has minimal protrusion from a top surface of the waterproof membrane 120 (e.g., the drain 130 has minimal protrusion above the adhesive-promoting surface of the waterproof membrane 120). Although the figures generally depict a linear drain (e.g., an elongated drain shown as spanning some width of the shower base 100), the drain 130 may be formed in other shapes, such as a conventional round or oval drain.

The drain 130 may be located at a point of lowest elevation from a subfloor 16 beneath the shower base 100. For instance, in various figures, the drain 130 is seated at an end of the shower base 100 based on the linear slope of the shower base 100. This allows water to flow along the slope of the shower base 100 and to be received by the drain 130 (e.g., water flows from height $h_1$ of the spacer layer 110 to height $h_2$ of the spacer layer 110).

Figure 3B:
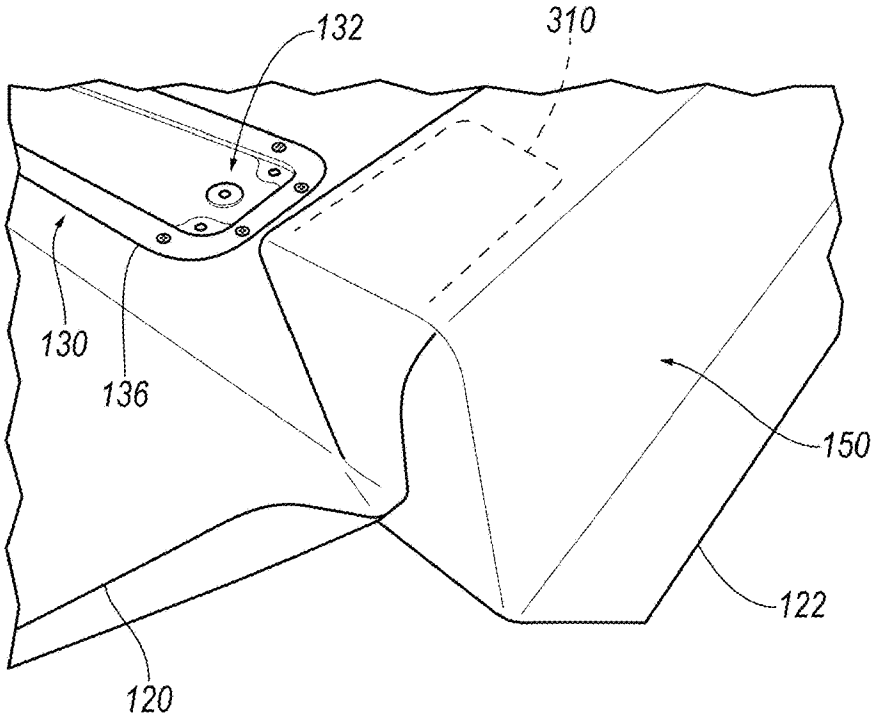
FIGS. 3A and 3B are perspective views of a corner of the shower base of FIG. 1B that includes a reinforced folding corners for a waterproof membrane.
Figure 3A:
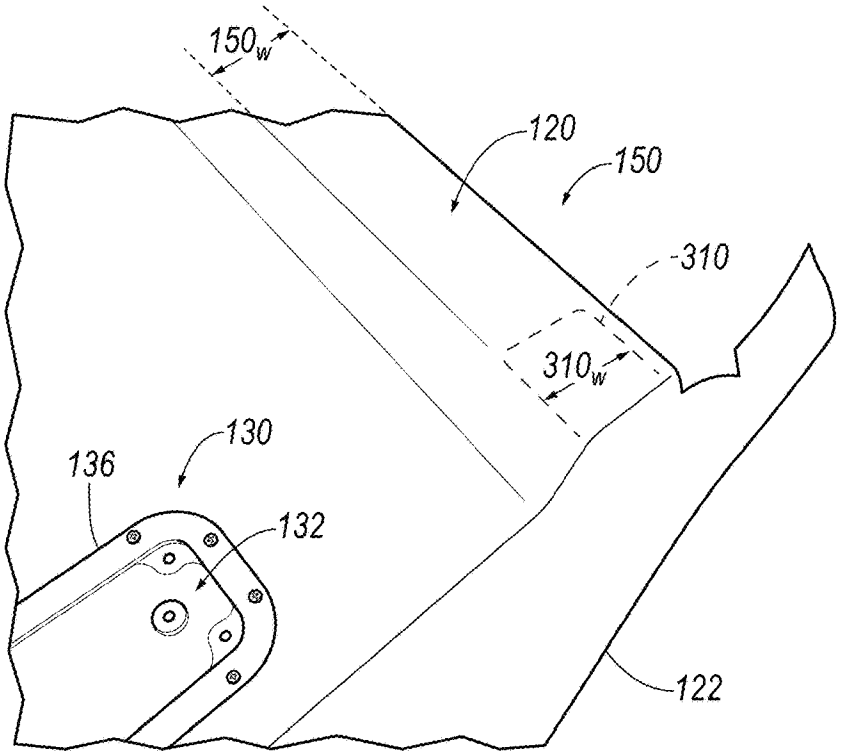
Figure 3D:
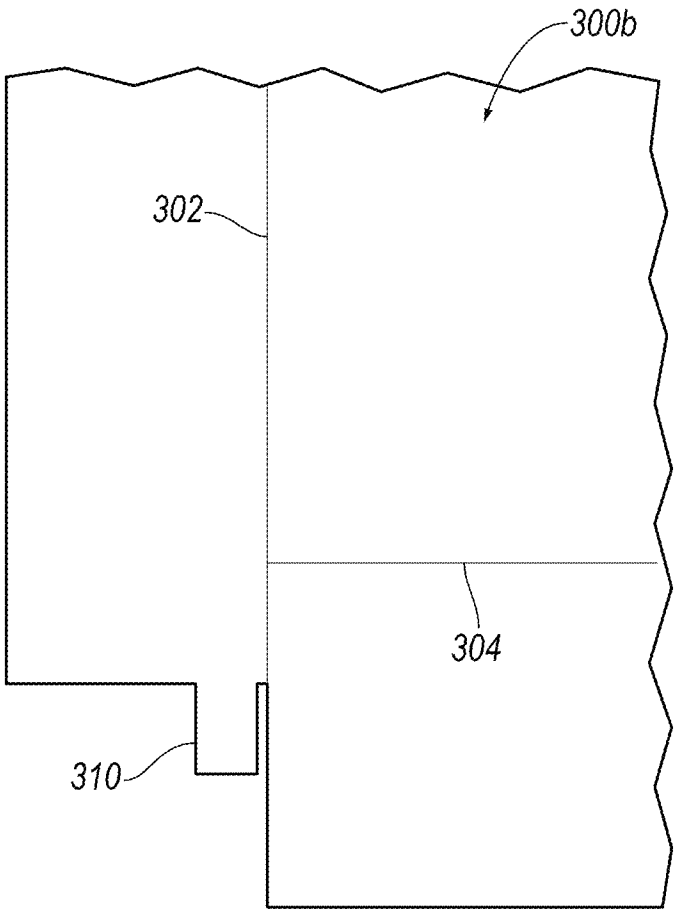
FIGS. 3C and 3D are top views of an example folding corners for a waterproof membrane.

In some examples, the drain 130 includes a drain hole 131, a water-source-facing top surface 132 and a bottom surface 134. The drain hole enables the drain 130 to connect to a drainpipe associated with the plumbing in the shower base environment 10. In some examples, the drain 130 additionally includes a clamping member 136 (e.g., partially shown in FIGS. 3A and 3B) or clamping flange that resembles a collar that surrounds the perimeter of the drain 130. The clamping member 136 is configured to be secured to a housing of the drain at the top surface 132 (e.g., by fasteners—shown as screws with a layer of sealant). For instance, both FIGS. 3A and 3B depict the clamping member 136 secured to the drain 130 at the top surface 132 by screws and a layer of sealant (hidden under the clamping member 136 against the top surface 132). When the clamping member 136 is secured to the top surface 132 of the drain 130, the clamping member 136 protrudes (or extends) from the top surface 132 by a thickness of the clamping member 136. When a finishing layer (such as tile) is applied on top of the waterproof membrane 120, generally the thickness of the finishing layer results in the height from the subfloor 16 to the water source-facing surface of the finishing layer that is greater or at least equal to the height from the subfloor 16 to a top surface of the clamping member 136.

In some examples, during construction of the shower base 100, the waterproof membrane 120 includes a portion that at least partially overlaps the drain 130. The clamping member 136 is configured to clamp the at least partially overlapping portion of the waterproof membrane 120 against the top surface 132 of the drain 130. In other words, this may form a rigid water barrier by the clamping force from the fasteners and sealant in order to prevent water from leaking underneath the waterproof membrane 120 as water flows towards the drain 130. Additionally or alternatively, a portion of the waterproof membrane 120 may be bonded or otherwise adhered to a portion of the drain 130. For example, the drain 130 may be designed without a clamping member 136 and, instead of the water barrier being formed by the clamping member 136, the water barrier is formed by some bond or configuration of the drain 130. In some examples, the drain 130 includes a recessed cavity adjacent the drain hole 131 to promote water drainage and/or to prevent water buildup at the barrier formed by the clamping member 136. Although, the top surface 132 of the drain 130 is water-source-facing, the drain 130 may include a grate or other additional structure disposed on the "top surface 132" to allow a flush or relatively seamless look from a transition between a top surface of a tile layer and the drain 130.

Figure 1D:
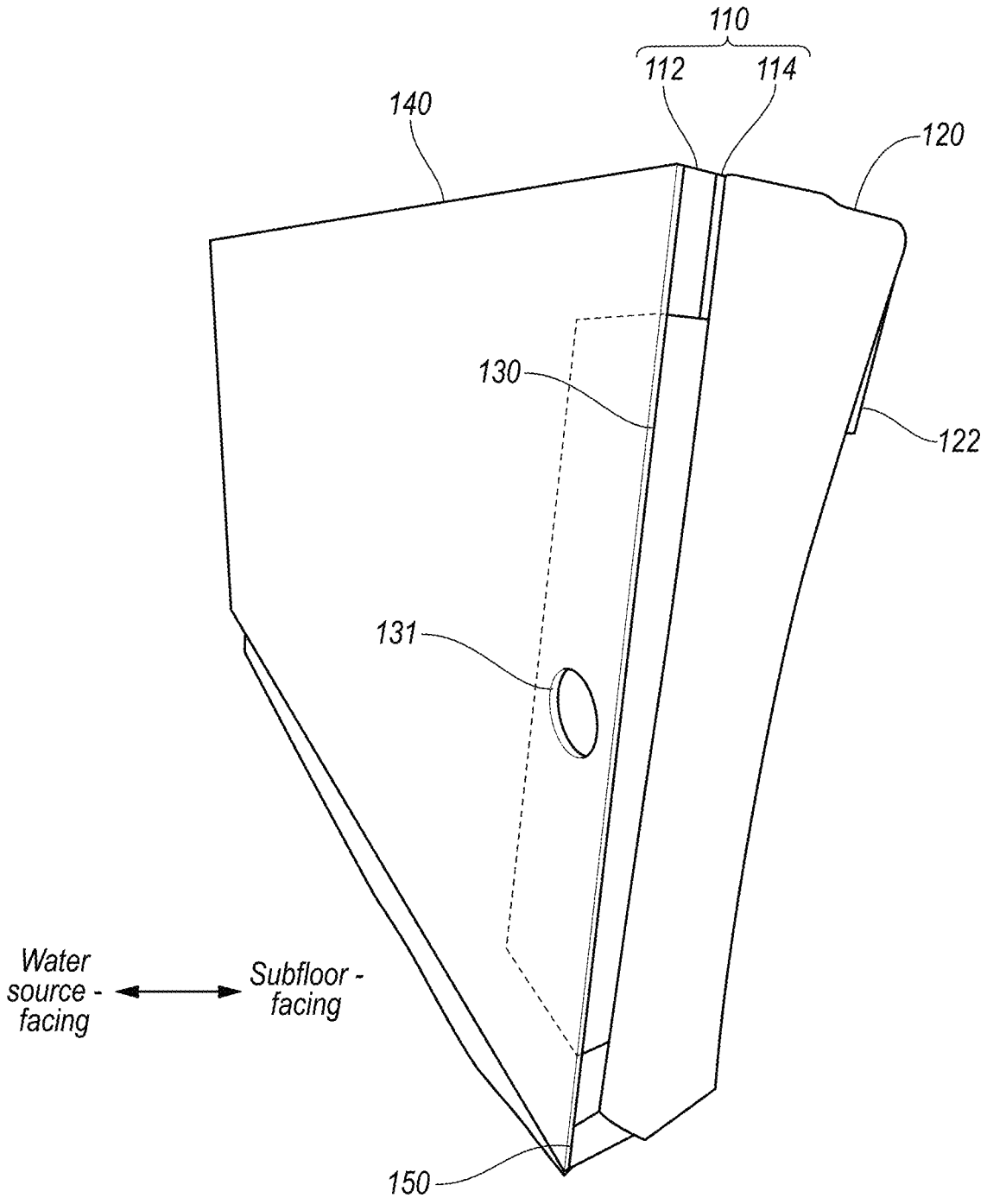
Figure 1E:
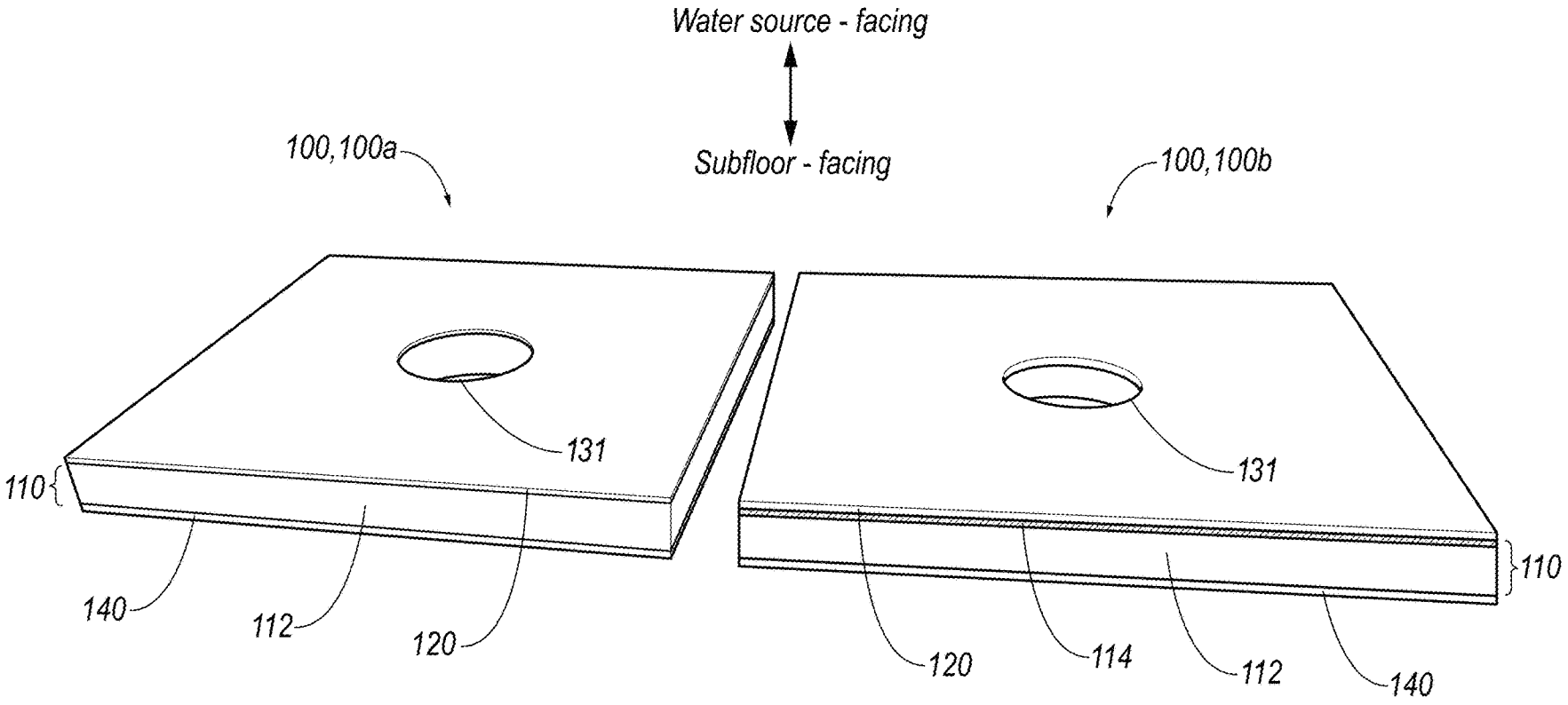
FIG. 1E is a perspective view of example spacer layers for a shower base.
Figure 2B:
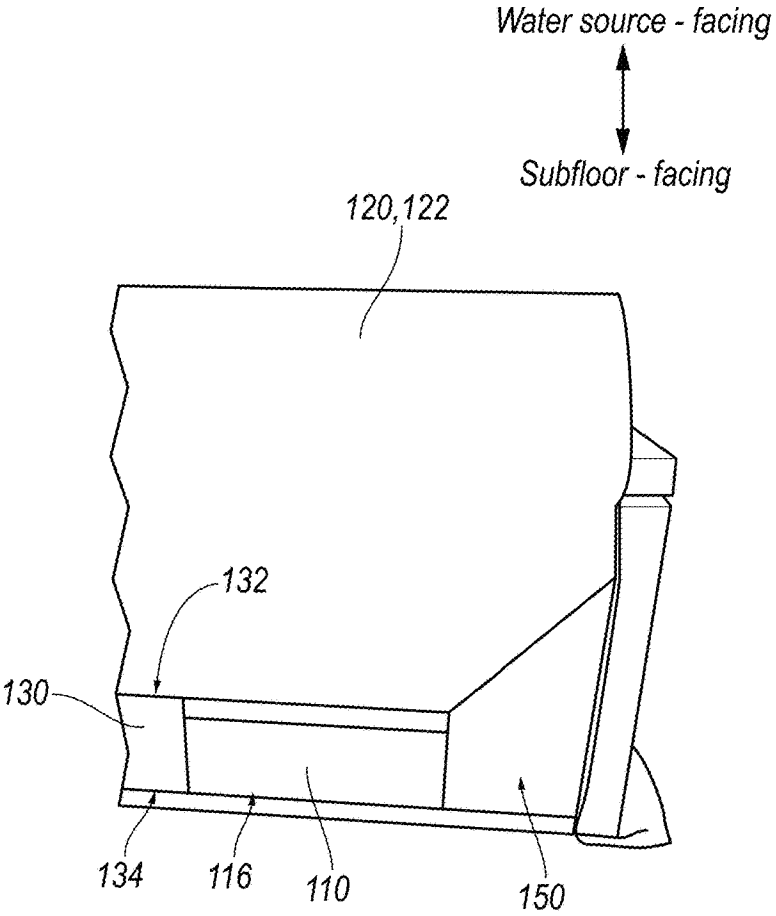
FIGS. 2A and 2B are enlarged perspective views of the example shower base of FIG. 1B.

Referring to FIGS. 1D and 2B, the drain 130 (or the drain housing) is shown as an elongated component (e.g., spanning some width) of the shower base 100. As discussed above, generally the drain 130 is beneath the waterproof membrane 120 except for the clamping member 136 or other drain cover (e.g., the drain cover 139 shown in FIG. 2D). With particular reference to FIG. 2B, the bottom surface 134 of the drain 130 may be configured relatively coplanar (e.g., flush) with a bottom surface 116 of the spacer layer 110 (e.g., the bottom surface 116 functions as a backer-layer mounting surface). In this configuration, a backer layer 140 may include a hole (e.g., a drain hole 131 as shown in FIG. 1E) that allows plumbing pipes to connect to the drain 130. When the shower base 100 includes the backer layer 140, the drain 130 may be disposed on and/or secured to a top surface of the backer layer 140 (e.g., a water-source facing surface). When the drain 130 has a profile where the bottom surface 134 is relatively coplanar (e.g., flush) with another layer of the shower base 100, an installer of the shower base 100 does not have to worry about a few potential issues with drain installation and plumbing pipe connections. For instance, the drain 130 does not have to be inset into the subfloor 16 in the shower area. This alleviates potential alignment issues between plumbing and the shower base 100. Additionally or alternatively, this flush design prevents parts of the drain 130 from protruding from the overall bottom surface of the shower base 100. Unfortunately, if parts of the drain 130 protrude, these parts have a higher risk of breaking or being damaged during transport or installation of the shower base 100.

Figure 2A:
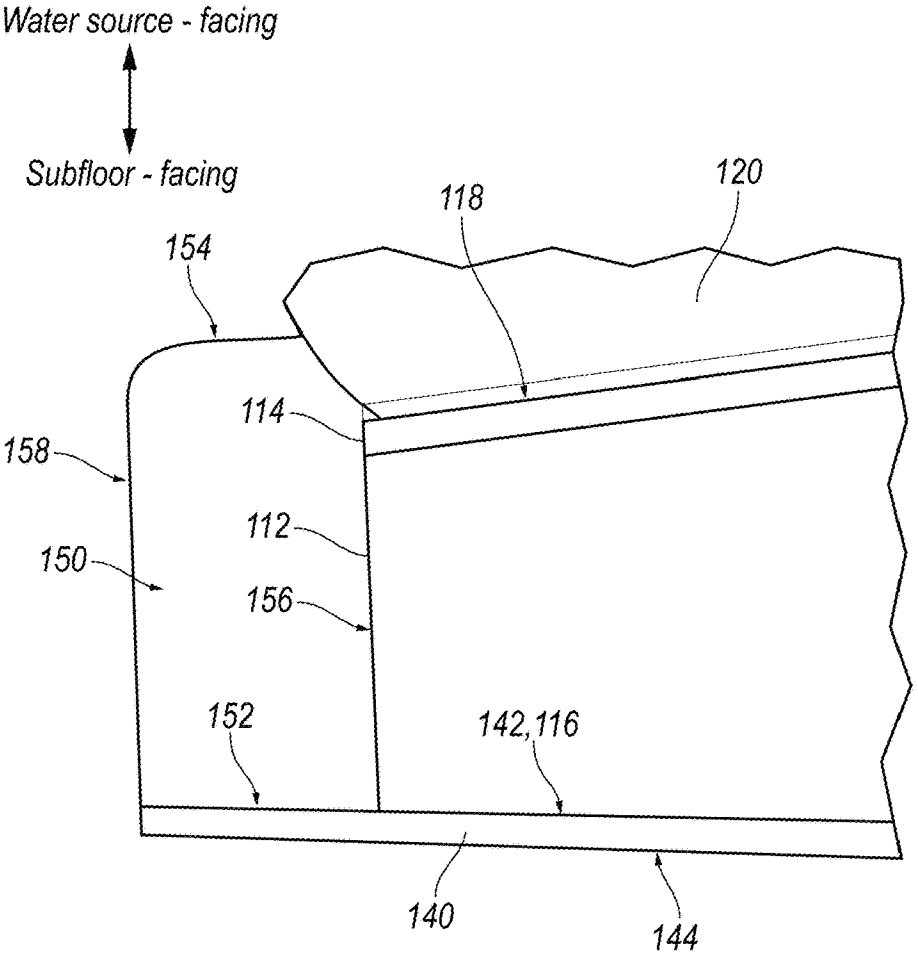
Figure 2C:
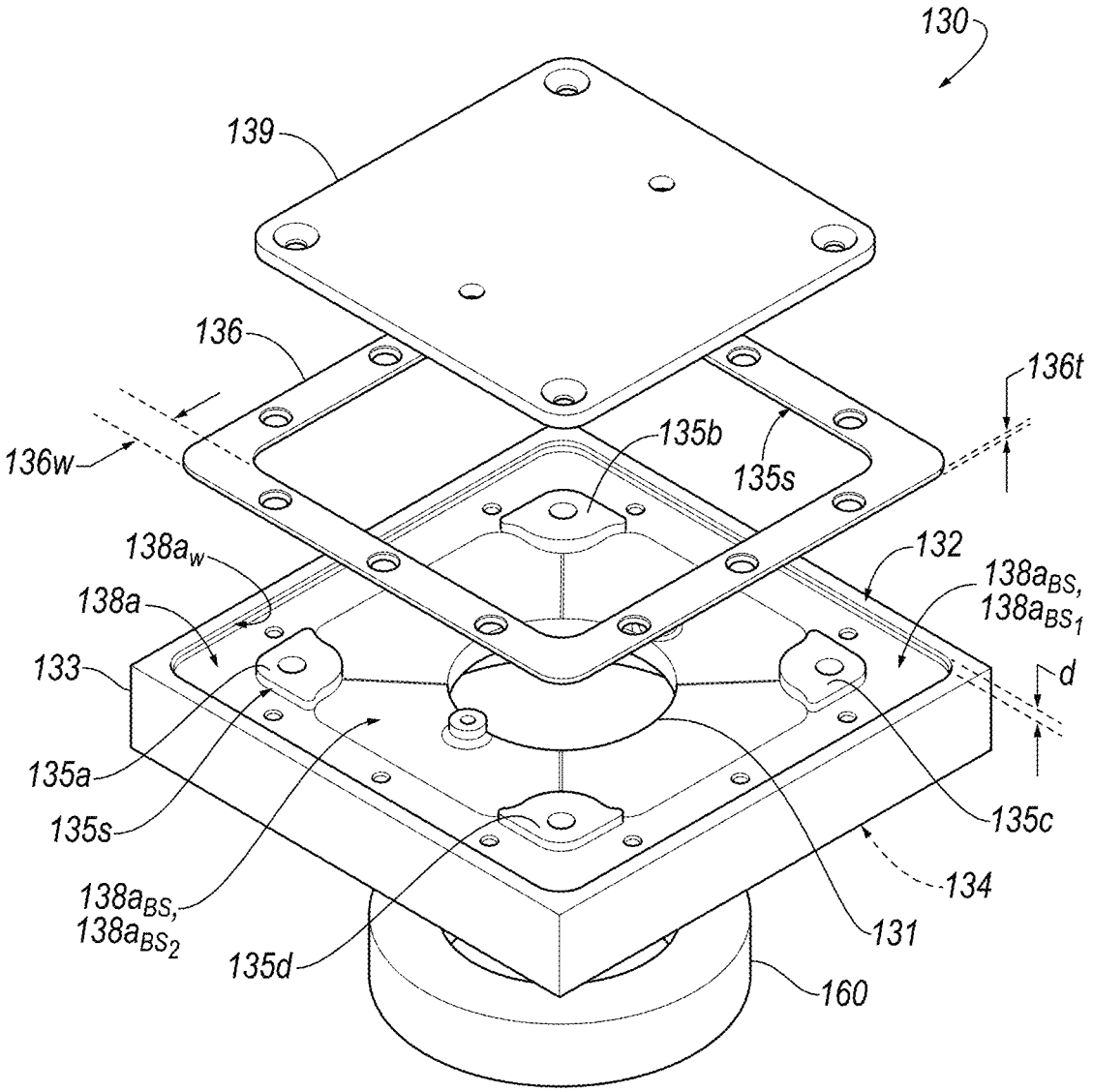
FIGS. 2C-2E are schematic views of example drain adapters for a shower base.
Figure 2D:
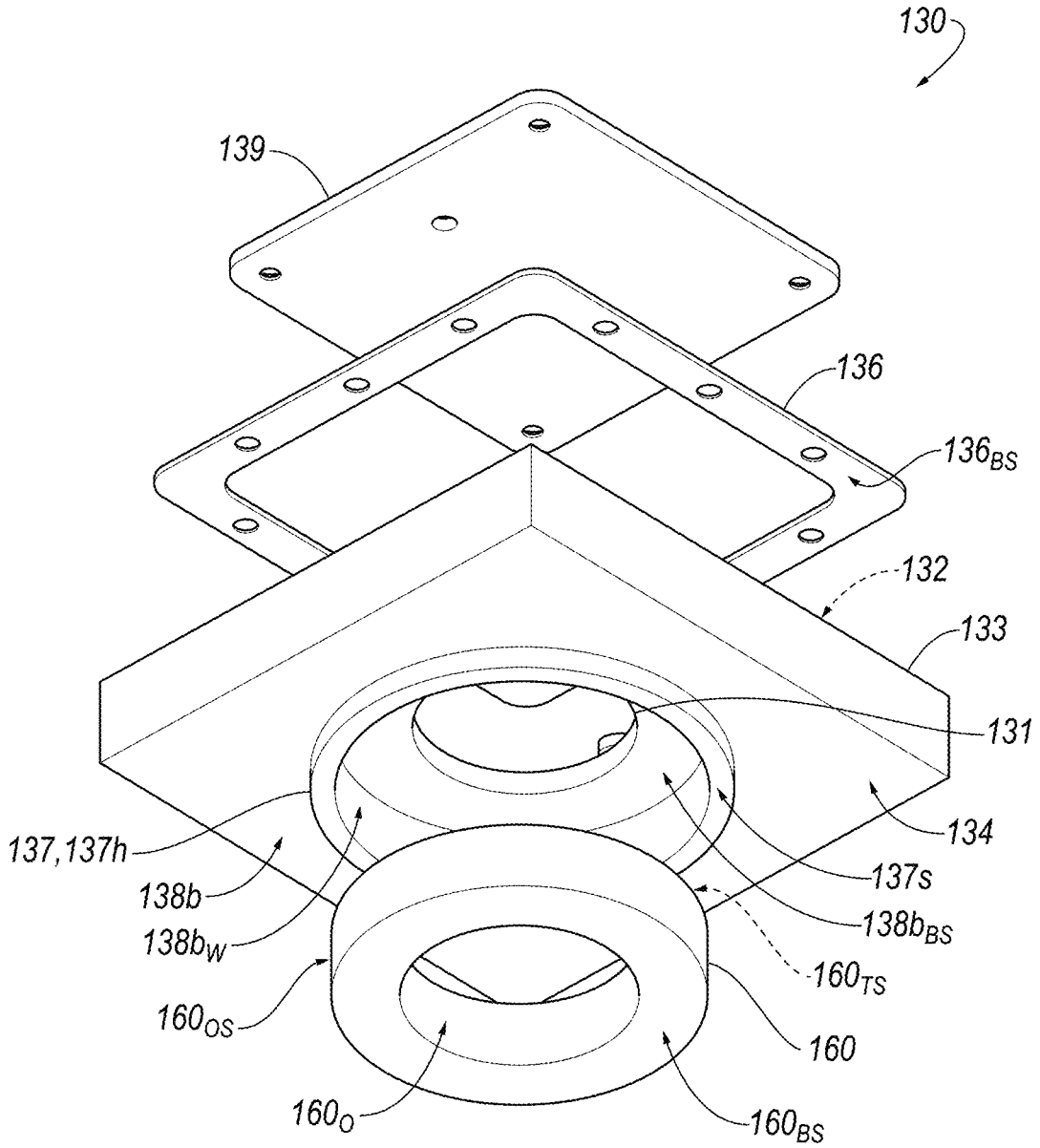
Figure 2E:
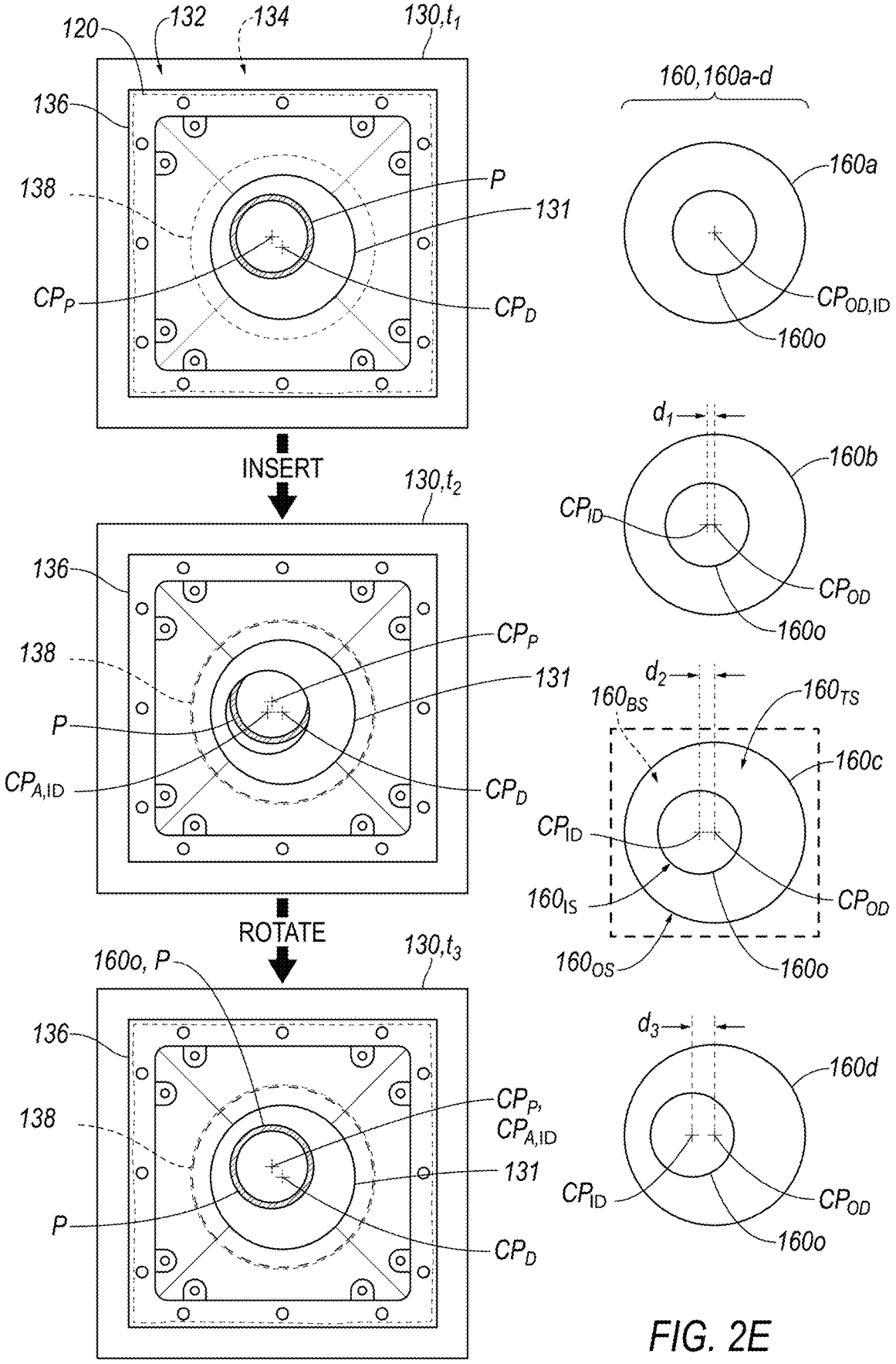

In some configurations, the drain 130 includes a drain adapter 160 (e.g., as shown in FIGS. 2C-2E). The drain adapter 160 is a component that decreases misalignment between the plumbing connection and the drain connection for the drain 130 of the shower base 100. In other words, the drain 130 and the plumbing connections for the shower base 100 may be slightly out of alignment (e.g., +/−0.5"). In this scenario, the drain adapter 160 is configured to adapt to the misalignment. For instance, the drain adapter 160 is rotatable between adapter increments (e.g., shown as ⅛", ¼", ⅜") such that an installer may select an adapter position corresponding to the variance between the position of the drain 130 (e.g., the drain hole 131) and the plumbing piping. For instance, the installer selects an adapter 160 and rotates the adapter 160 to a position that better aligns the plumbing connection and the drain connection to the plumbing. In some examples, there may be multiple adapters 160 where each adapter 160 has a single adapter opening $\mathbf{160}_O$ formed by an inner surface $\mathbf{160}_{IS}$ with a center point $CP_{ID}$ of the opening $\mathbf{160}_O$ a set distance from the overall center point $CP_{OD}$ of the adapter 160. For instance, FIG. 2E shows four different adapters 160, 160*a-d* (e.g., shown as one concentric adapter and three eccentric adapters) where each adapter 160 is able to adapt to a particular offset distance d. To illustrate the first adapter 160*a* is a centered adapter with no offset such that the overall center point $CP_{OD}$ is the same as the center point $CP_{ID}$ of the opening $\mathbf{160}_O$. The second adapter 160*b* has a first offset distance $d_1$ (e.g., ⅛") between the overall center point $CP_{OD}$ and the center point $CP_{ID}$ of the opening $\mathbf{160}_O$. The third adapter 160*c* has a second offset distance $d_2$ (e.g., ¼") between the overall center point $CP_{OD}$ and the center point $CP_{ID}$ of the opening $\mathbf{160}_O$. The fourth adapter 160*d* has a third offset distance $d_3$ (e.g., ⅜") between the overall center point $CP_{OD}$ and the center point $CP_{ID}$ of the opening $160_O$. In other examples, in contrast to a single adapter 160 with a single opening having a particular offset, the adapter 160 may be configured with multiple openings or a single opening with multiple lobes (not shown) where each lobe corresponds to an adapter increment (e.g., a ⅜" lobe, a ¼" lobe, and a ⅜" lobe). In either design, the adapter 160 allows on-site adjustments such that when deviations in the plumbing occur on-site, the shower base 100 does not necessarily need to be returned to the manufacturer to be modified or redone. For example, by rotating the adapter 160, a center point $CP_{ID}$ of an opening $160_O$ of the adapter 160 may move along a path (e.g., a generally circular path for a generally circular adapter) and align the opening $160_O$ with another opening, such as an opening for a plumbing connection (e.g., a plumbing pipe), that exists along or near the path.

FIGS. 2C and 2D are examples of a drain 130 that incorporates the adapter 160. Here, to be more specific, the top surface 132 and the bottom surface 134 of the drain 130 are the top surface 132 and the bottom surface 134 for a drain housing 133. The drain housing 133 is shown as a generally rectangular prism (e.g., a square prism). In some examples, such as FIGS. 2C and 2D, the housing 133 includes two recesses 138, 138*a-b*. The first recess 138*a* functions to receive the clamping member 136 while the second recess 138*b* functions to receive the adapter 160. The first recess 138*a* is formed by recessing the top surface 132 of the drain housing 133 by a particular depth d such that the first recess 138*a* has a recess wall $138a_w$ with a height equal to the depth d where the height extends from a bottom surface $138a_{BS}$ of the first recess 138*a* to the top surface 132 of the drain housing 133. In some implementations, the depth d is greater than or equal to a thickness 136*t* of the clamping member 136 in order to prevent or inhibit fasteners or other means of securement from protruding from the top surface 132 of the housing 133 when these fasteners (or other means of securement) secure the clamping member 136 to the housing 133. In some configurations, the first recess 138*a* forms a channel with a width equal to or greater than a width of the clamping member 136 in order to allow the clamping member 136 to seat itself (e.g., partially or completely) within the channel. By placing a portion of the waterproof membrane 120 between the bottom surface $138a_{BS}$ of the first recess 138*a* and the clamping member 136, the clamping member 136 may be tightened by fasteners into the housing 133 and be drawn into the channel of the first recess 138*a* and against the waterproof membrane 120. The securement of the clamping member 136 into the housing 133 and against the waterproof membrane 120 may slightly compress the waterproof membrane 120 and form an interface that functions to provide a mechanical barrier that prevents water from seeping under the waterproof membrane 120 when water flows toward the drain hole 131 of the drain 130.

In some implementations, the bottom surface $138a_{BS}$ of the first recess 138*a* includes a flat portion $138a_{BS1}$ and a sloped portion $138a_{BS2}$. Here, the flat portion $138a_{BS1}$ of the first recess 138*a* is the area of the first recess 138*a* that receives the clamping member 136 (e.g., mates with a bottom surface $136_{BS}$ of the clamping member 136) while the sloped portion $138a_{BS2}$ is not in contact with the clamping member 136. Rather, the sloped portion $138a_{BS2}$ functions to promote water to flow down (i.e., in a direction toward the subfloor 16) the slope of the sloped portion $138a_{BS2}$ from flat portion $138a_{BS1}$ to the drain hole 131. For instance, FIG. 2C depicts multiple sloped portions $138a_{BS2}$ (i.e., multiple sloped surfaces) radiating from the drain hole 131 to the flat portion $138a_{BS1}$ of the bottom surface $138a_{BS}$ of the first recess 138*a*.

Additionally or alternatively, the top surface 132 of the drain housing 133 may include a non-recessed portion that forms one or more posts 135. These posts 135 may function to receive the drain cover 139 (e.g., a drain screen, drain grate, or other type of drain covering). As an example, the posts 135 may be bored out (e.g., tapped) to receive fasteners that extend through the drain cover 139 into the posts 135 to secure the drain cover 139 to the drain housing 133. FIG. 2C is an example that illustrates four posts 135 that align with four corners of the drain cover 139. In this example, the four posts 135*a-d*, at least partially, form a boundary wall of the channel that receives the clamping member 136. In other words, each post 135 includes a surface 135*s* that may mate with, abut, or be located adjacent to a surface 136*s* of an inner wall of the clamping member 136. Here, with the post 135 forming a boundary for the clamping member 136, the drain cover 139 may be secured to each post 135 without interfering with the function of the clamping member 136. In some configurations, this means that the drain cover 139 is offset some distance from the clamping member 136 towards the drain hole 131. In some implementations, the clamping member 136 and the drain cover 139 are coaxial or concentric with respect to the center point CP of the drain hole 131.

In some examples, such as FIG. 2D, the drain 130 is configured to receive the adapter 160 in a recess 138 (e.g., shown as the second recess 138*b*). For example, the bottom surface 134 is recessed to form the second recess 138*b* (e.g., a recessed channel) sized to the shape of the drain adapter 160 in order to receive the drain adapter 160. By recessing the bottom surface 134, the second recess 138 includes a bottom recess surface $138b_{BS}$ and a recess wall $138b_W$ that extends from the bottom surface $138b_{BS}$ of the second recess 138*b* to at least the bottom surface 134 of the drain 130. In other words, a height of the recess wall $138b_W$ may define a depth that the second recess 138*b* extends into the bottom surface 134 of the drain 130. Here, the second recess 138*b* is circular to receive the generally circular shape of the adapter 160 such that the recess wall $138b_W$ circumferentially surrounds the adapter 160. When the adapter 160 is received by the second recess 138*b* (e.g., inserted in the second recess 138*b*), an outer surface/wall $160_{OS}$ of the drain adapter 160 may mate with, abut, or be located adjacent to the recess wall $138b_W$ of the second recess 138. Additionally when the adapter 160 is received by the drain 130 (e.g., inserted in the second recess 138*b*), the top surface $160_{TS}$ of the adapter 160 (opposite a bottom surface $160_{BS}$ of the adapter 160) mates with (e.g., is adhered to) part of the recess 138 (e.g., the bottom surface $138_{BS}$ of the second recess 138*b*) that is on a plane parallel to the bottom surface 134 of the drain 130 (i.e., offset from the bottom surface 134 by a depth of the recess 138).

In some configurations, the adapter 160 may be located at different places with respect to the subfloor 16 depending on a configuration of the drain 130. For instance, when the drain 130 exists entirely above the subfloor 16, the adapter 160 may also exist above the subfloor 16. In contrast, when the drain 130 extends through the subfloor 16 or to some depth into the subfloor 16, the adapter 160 may be located at least partially within the subfloor 16. For example, the bottom surface $160_{BS}$ of the drain adapter 160 is located within the thickness of the subfloor 16 (e.g., the adapter 160 is located at least partially in a recess of the subfloor 16). Alternatively, when the drain 130 extends through the subfloor 16, the adapter 160 may be located below the subfloor 16 such that the top surface $\mathbf{160}_{TS}$ of the adapter 160 is below the subfloor 16.

In some implementations, such as FIG. 2D, the bottom surface 134 may be additionally extruded towards the subfloor 16 or into the subfloor 16 to increase the height of the recess wall $\mathbf{138}b_w$. For instance, the drain adapter 160 may be constructed with a thickness that where, if the bottom surface 134 was recessed a depth equal to this thickness, it may compromise some structural integrity of the drain 130 (e.g., of the drain hole 131). For example, the thickness between the bottom surface $\mathbf{138}_{BS}$ of the second recess 138*b* and the top surface 132 of the drain 130 becomes too thin. To account for this, the bottom surface 134 may be extruded in a direction away from the top surface 132 to increase the depth of the recess 138 for the adapter 160. For instance, this extrusion process forms a lip 137 with a given height 137*h*. To illustrate, referring to FIG. 2D, the height 137*h* of the lip 137 plus the depth of the second recess 138*b* into the bottom surface 134 equals a height of the recess wall $\mathbf{138}b_w$. With this particular construction, the bottom surface $\mathbf{160}_{BS}$ of the adapter 160 may be coplanar with a surface 137*s* of the lip 137 (e.g., the surface 137*s* of the lip 137 that is coplanar with the bottom surface 134 of the drain 130) when the adapter 160 is seated within the recess 138 (e.g., the second recess 138*b*).

FIG. 2E depicts an example of a plumbing connection P (shown as a diagonally hatched pipe) that is misaligned with the drain 130. For instance, FIG. 2E illustrates that a center point $CP_P$ for the pipe P is offset from a center point $CP_D$ of the drain 130. In some configurations, when the adapter 160 is positioned to compensate for the misalignment of the plumping pipe P, the adapter 160 is secured to the recess wall $\mathbf{138}_W$ of the recess 138 (e.g., shown in FIGS. 2C and 2D as the recess wall $\mathbf{138}b_w$ of the second recess 138*b*). To illustrate, FIG. 2E shows a dotted or hidden line that indicates the recess wall $\mathbf{138}_W$ of the recess 138. For instance, the adapter 160 is bonded (e.g., adhered, fastened) or locked into place (e.g., with a mechanical interference fit) in the drain 130 (e.g., into the recess 138 of the drain 130) when the adapter 160 is in the desired position. In some implementations, an installer selects an adapter 160 based on the offset between the center point $CP_P$ of the plumbing pipe P and the center point $CP_D$ of the drain 130. In FIG. 2E, the installer selects the third adapter $\mathbf{160}_C$ (e.g., shown by the selection box in dashed lines) since its offset distance $d_2$ most closely matches the offset between the center point $CP_P$ of the plumbing pipe P and the center point $CP_D$ of the drain 130. Referring to FIG. 2E, the installer inserts the adapter 160 into the drain 130 (e.g., seats the adapter 160 into the second recess 138*b*) and may then rotate the adapter 160 until the adapter 160 aligns with the plumbing pipe P. FIG. 2E depicts a vertical installation sequence where, at a first time $t_1$, the drain 130 is offset from the plumping pipe without an adapter 160. At a second time $t_2$, the installer places the selected adapter 160 into the drain 130 (e.g., into the recess 138), but the center point $CP_{A,\,ID}$ of the adapter 160 is not yet aligned with the center point $CP_P$ of the plumbing connection P. Since the center point $CP_{A,\,ID}$ of the adapter 160 is not yet aligned with the center point $CP_P$ of the plumbing connection P, the installer rotates the adapter 160 clockwise until the center point $CP_{A,ID}$ of the adapter 160 generally aligns with the center point $CP_P$ of the plumbing connection P as shown at a third time $t_3$. This alignment may better or perfectly align the center points CP of the adapter 160 and plumbing connection P (e.g., as shown) or simply reduce the misalignment to within a threshold tolerance in order for the shower base 100 to connect to the plumbing connection P. Although the adapter 160 is shown with a generally circular shape to simplify the rotation of the adapter 160, the adapter 160 may be designed in other shapes that also promote an alignment between a plumbing connection for the shower base 100 (e.g., the drain 130) and the plumbing in the shower area.

In some examples, such as FIGS. 2A and 2B, the shower base 100 includes the backer layer 140 (e.g., that forms an overall base layer for the shower base 100). The backer layer 140 is configured to function as a stiffener for portability of the shower base 100. In other words, although the other layers 110, 112, and 114, and the membrane 120 may have some stiffness to support transport and construction of the shower base 100, the backer layer 140 may provide increased support for these purposes. In some examples, the backer layer 140 is constructed from different materials than the other layers of the shower base 100. In yet other examples, the backer layer 140 is formed of materials similar to the other layers of the shower base 100. For example, the backer layer 140 is formed from the same materials as the load support layer 114. Here, by being formed from the same materials as the load support layer 114, the manufacturer of the shower base 100 may limit the number of different materials required for the construction of the shower base 100 and thus, potentially limit different quality issues arising from dissimilar material interaction.

As shown in FIGS. 2A and 2B, the backer layer 140 includes a top surface 142 (i.e., a water-source facing surface) and a bottom surface 144 (i.e., a subfloor mounting surface) opposite the top surface 142. In some examples, the backer layer 140 is configured to adhere to the subfloor 16 in a shower area. For example, the bottom surface 144 adheres directly to the subfloor 16 in the shower area. In some implementations, as discussed above one or more components/layers of the shower base 100 may be adhered to the top surface 142 of the backer layer 140. For instance, FIGS. 2A and 2B depict a bottom surface 152 of one of the one or more curbs 150 adhered to the top surface 142, the bottom surface 116 of the spacer layer 110 (i.e., a base-layer mounting surface of the spacer layer 110) adhered to the top surface 142, and a bottom surface 134 of the drain 130 adhered to the top surface 142.

As stated previously, in some implementations, the shower base 100 includes one or more curbs 150. The curbs 150 generally refer to a perimeter wall on part of or entirely along at least one side of the shower base 100. Depending on the customization and design of the shower base 100, the one or more curbs 150 may be of varying height (e.g., varying height along a single curb 150 or of different heights when comparing two curbs 150). For instance, FIG. 1B depicts a first curb 150 at an end opposite the drain 130 and a second curb 150 orthogonal to the first curb 150 and extending along a length of the shower base 100 from the end with the drain 130 to the end with the first curb 150. Here, the second curb 150 is a uniform height along its length even though optically it may appear to vary because of the sloped surface of the shower base 100 towards the drain 130. Referring to FIG. 1A, the shower base 100 includes two curbs 150 where each curb 150 is a different, yet uniform height. In some examples, the curb 150 is defined by its height that protrudes above the overall top surface of the shower base 100. Here, this height may be generally defined as a height from above the top surface 118 of the spacer layer 110 (e.g., a waterproof membrane mounting surface) to a top surface 154 of the curb 150.

The curb 150 may vary in shapes and sizes though, for simplicity of illustration, the curbs 150 are generally shown throughout the figures as rectangular prisms. In some examples, such as FIG. 2A, the curb 150 includes the bottom surface 152, a top surface 154 opposite the bottom surface 152, a first side 156 facing the spacer layer 110 (or the inner portion of the shower base 100), and a second side 158 facing an area external to the shower base 100. In some implementations, the curb 150 is adhered to the shower base 100 (e.g., a side of the spacer layer 110) at the first side 156 of the curb 150. Here, when adhered to the shower base 100, the bottom surface 152 of the curb 150 may be relatively coplanar (e.g., flush) with the bottom surface 116 of the spacer layer 110 (e.g., to maintain flatness of the overall shower base 100). In some configurations, in order to maintain ease of installation, as shown in FIGS. 2A and 2B, each layer 110, 120, and 140 or component (e.g., the curb 150 and the drain 130) terminates in the same plane such that the overall side of the shower base 100 may be flush with a vertical securement surface such as a backer board 12 (e.g., drywall or other structural support adjacent the shower base 100).

Traditionally, a waterproof liner has been installed at a jobsite. This may be for several reasons, but often the installer makes cuts and folds specific to the shower area at the jobsite that are difficult to anticipate prior to installation. More often than not, the installer will ensure that any cuts or folds, which may compromise the waterproof integrity, include a flashing overlay. Flashing overlays may be available commercially and provide another barrier at junctures (e.g., between a shower base and shower boards (e.g., backer boards)) that may be susceptible to water leaks. Here, by needing to cut or to fold waterproof liners and/or flash areas around the shower base 100, the installer increases installation time and thus introduces increased labor costs as well as potential on-site human error to the waterproof integrity of the shower area.

Figure 4A:
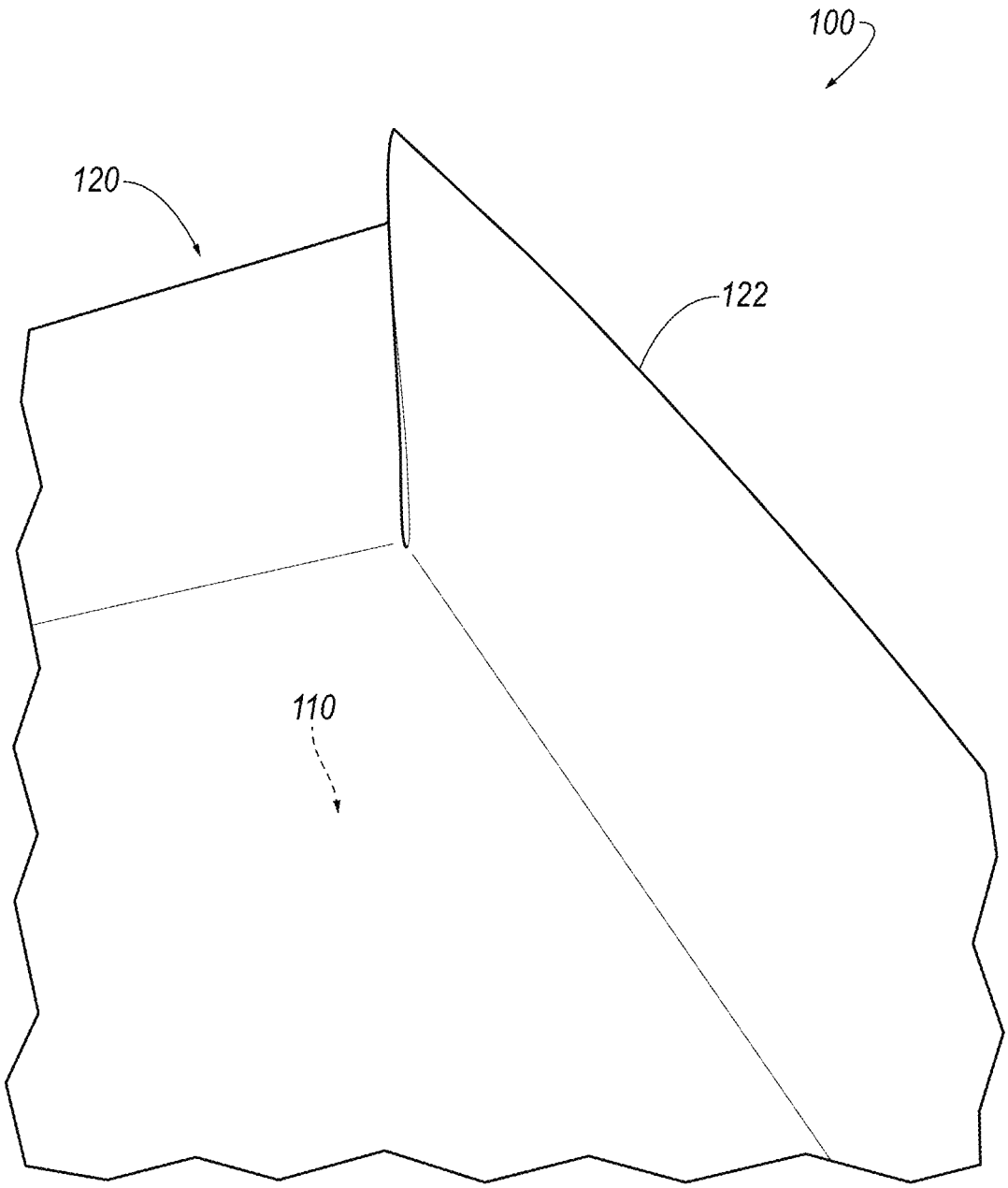
FIGS. 4A-4H are perspective views of operations to form the assembled shower base.

To overcome these issues, the shower base 100 is assembled with the waterproof membrane 120 (e.g., as shown in FIGS. 4A-4I) prior to installation at a job site. Therefore, the shower base 100 may be assembled as part of the shower base 100, cut, and/or the folded in an environment off-site from the job (i.e., remote from the jobsite in, for example, a manufacturing facility). By cutting and/or folding the waterproof membrane 120 before installation, the fabricator is able to water test the shower base 100 (e.g., as shown in FIG. 4I) prior to installation which removes the potential watertight issues of, for example, a custom shower base installation. Additionally or alternatively, this process may allow less skilled workers (e.g., a homeowner) to install the shower base 100 without increasing the risk of water issues. In other words, the waterproofing expert may be in the prefabrication shop ensuring that each shower base 100 complies with plumbing standards.

Another potential benefit with this approach is that a prefabricator may supply standard or custom shower bases 100 (e.g., 3'×5', 4'×4', 3'×3') with minimal additional effort. For example, installers have previously used injection-molded bases that potentially reduce some larger issues with the installation of a waterproof liner, but these injection-molded bases are generally unavailable in non-standard sizes without significantly increasing the cost. In other words, injection molding requires tooling and other resources that makes one-off customization expensive.

Figure 3C:
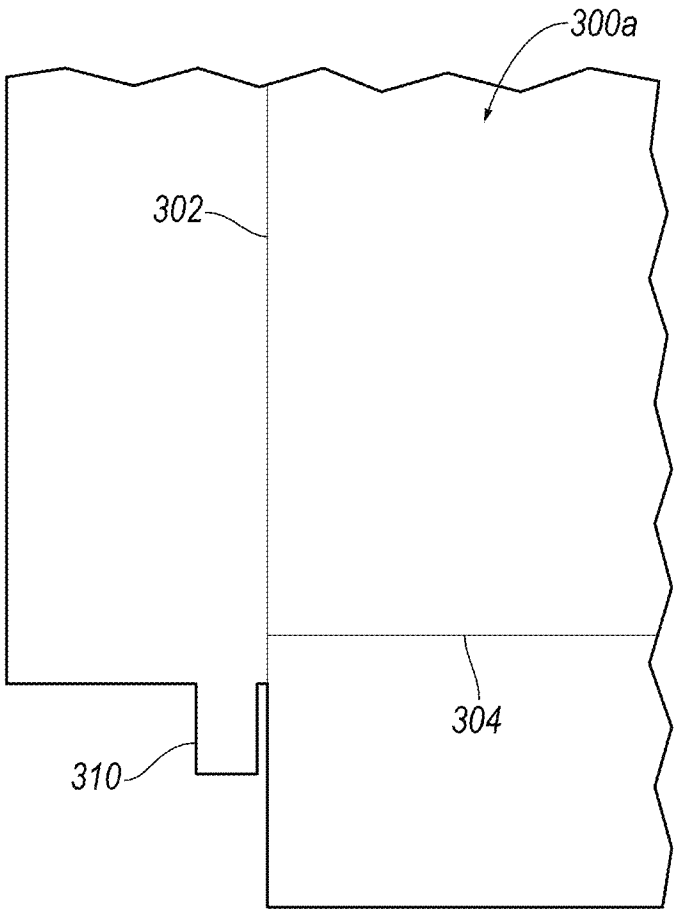

FIGS. 3A-3D show an embodiment of a corner 300 (300*a*, *b*) of the membrane 120. Here, the corner 300 may include a reinforced tab 310. In some examples, the reinforced tab 310 has a width 310*w* that is less than or equal to a width 150*w* of the top surface 154 of the curb 150 (e.g., such that the reinforced tab 310 does not overhang from the top surface 154 onto a side surface 156, 158 of the curb 150). These figures also depict that the corner 300 may be different depending on the height of the curb 150 at the corner 300 of the shower base 100 where the fold/cut occurs. For example, FIG. 3C shows the reinforced tab 310 to be closer to the curb edges (e.g., lines 302 and 304 represent the curb edges on the corner 300) in the first corner 300*a* that corresponds to a shallow portion of the shower base 100 near the drain 130 than the reinforced tab 310 of FIG. 3D of the second corner 300*b* that corresponds to a deeper portion of the shower base 100 (e.g., in a corner opposite the drain end). Referring back to FIGS. 3A and 3B, the dotted lines on the top surface 154 of the curb 150 show that the tab 310 has been inserted underneath the waterproof membrane 120 as the waterproof membrane 120 wraps around the curb 150 such that, in the location of the tab 310, the waterproof membrane 120 is reinforced (e.g., with double the thickness of the waterproof membrane 120). In this underneath tuck of the tab 310, the tab 310 may be adhered to the upper layer of waterproof membrane 120 (e.g., the waterproof membrane 120 wrapping around the curb 150) by caulk or some other form of adhesive (e.g., waterproof adhesive). This reinforcing process may allow a prefabricator to ensure that potentially critical corners (e.g., from a water leaking perspective) of the shower base 100 are watertight.

FIGS. 4A-4H illustrate operations for adhering the waterproof membrane 120 to the other layers/membrane/components of the shower base 100. FIG. 4A depicts the waterproof membrane 120 adhered to the top surface of the spacer layer 110 (e.g., the waterproof membrane mounting surface). In some examples, the waterproof membrane 120 is shown as a generally rectangular sheet that has been creased against an edge of the top surface of the spacer layer 110 with portions vertically arranged prior to wrapping and securing the overhang portions 122 of the waterproof membrane 120 to the shower base 100.

Figure 4B:
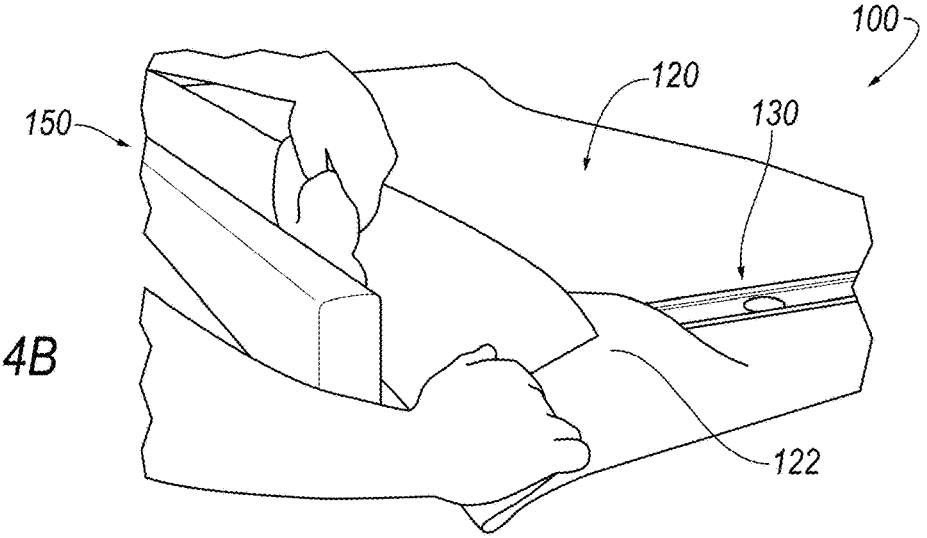
Figure 4C:
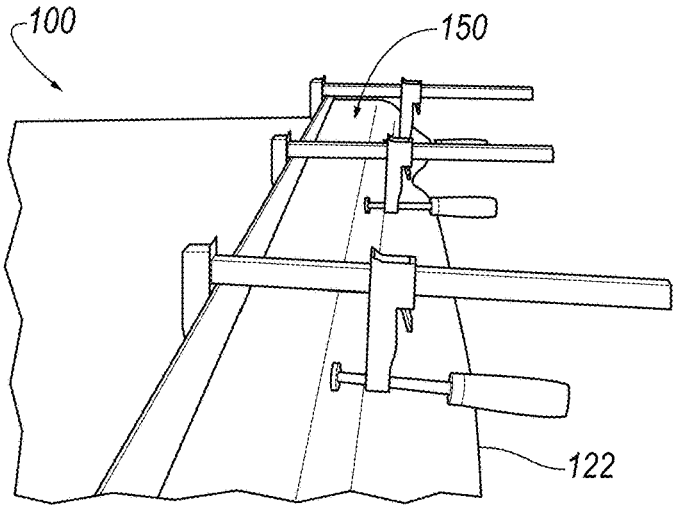
Figure 4D:
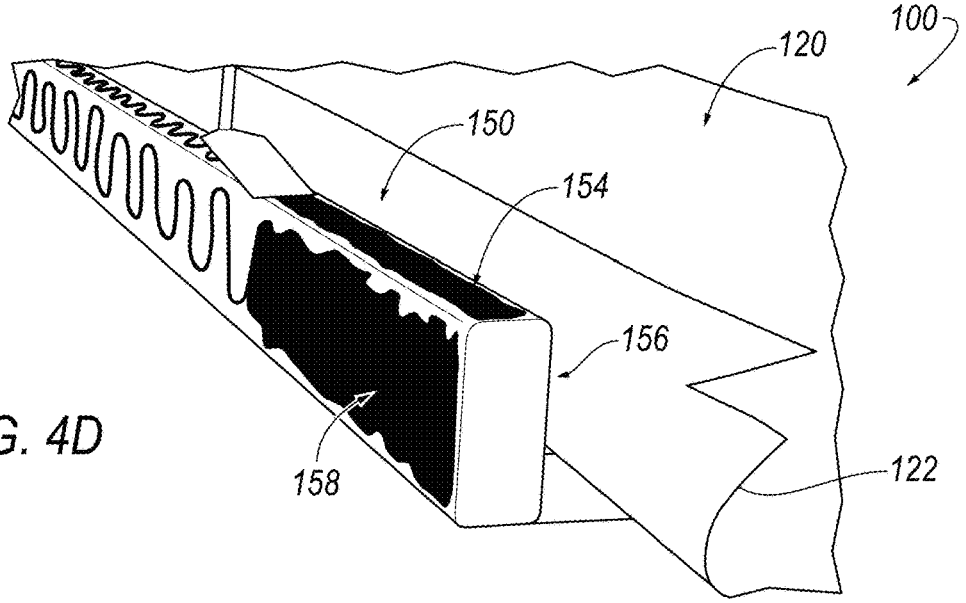

FIGS. 4B-4E are examples that illustrate one curb 150 of the one or more curbs 150 prior to receiving an adhesive (FIG. 4D); the one curb 150 receiving an adhesive (FIGS. 4B and 4D); and the waterproof membrane 120 (e.g., the overhang portions 122) being stretched and clamped into place once the waterproof membrane 120 is wrapped over and/or surrounds outer surfaces of the curb 150 (e.g., FIG. 4C). FIGS. 4B and 4D illustrate a worker off-site applying an adhesive along surfaces of the curb 150. Here, the adhesive is a moisture cure adhesive such that the worker wets the surface of the curb 150 with a sponge in FIG. 4B to initiate the adhesive to cure the curb 150 and the waterproof membrane 120 together. In FIG. 4D, a tool is being used to distribute the adhesive along the curb 150 such that the waterproof membrane adheres to the curb 150 and/or spacer layer 110 in a uniform manner (e.g., without voids).

Once the adhesive is applied, the waterproof membrane 120 may be clamped in place on the curb 150 to ensure strong adhesion. For instance, FIG. 4C depicts bar clamps and a bar that draw the waterproof membrane 120 to the edge where the side of the curb 150 meets the spacer layer 110 (e.g., to secure/ensure flatness of the waterproof membrane 120 over a three-dimensional shape—e.g., the curb 150). Here, the bar extends along a length of the curb 150 to distribute the clamping force of the clamps along the curb 150. Although FIG. 4D shows the entire curb 150 coated in adhesive, such that the waterproof membrane 120 would be adhered to the curb 150 potentially all at once, in some examples, the waterproof membrane 120 is adhered to the curb 150 one surface at a time.

Figure 4E:
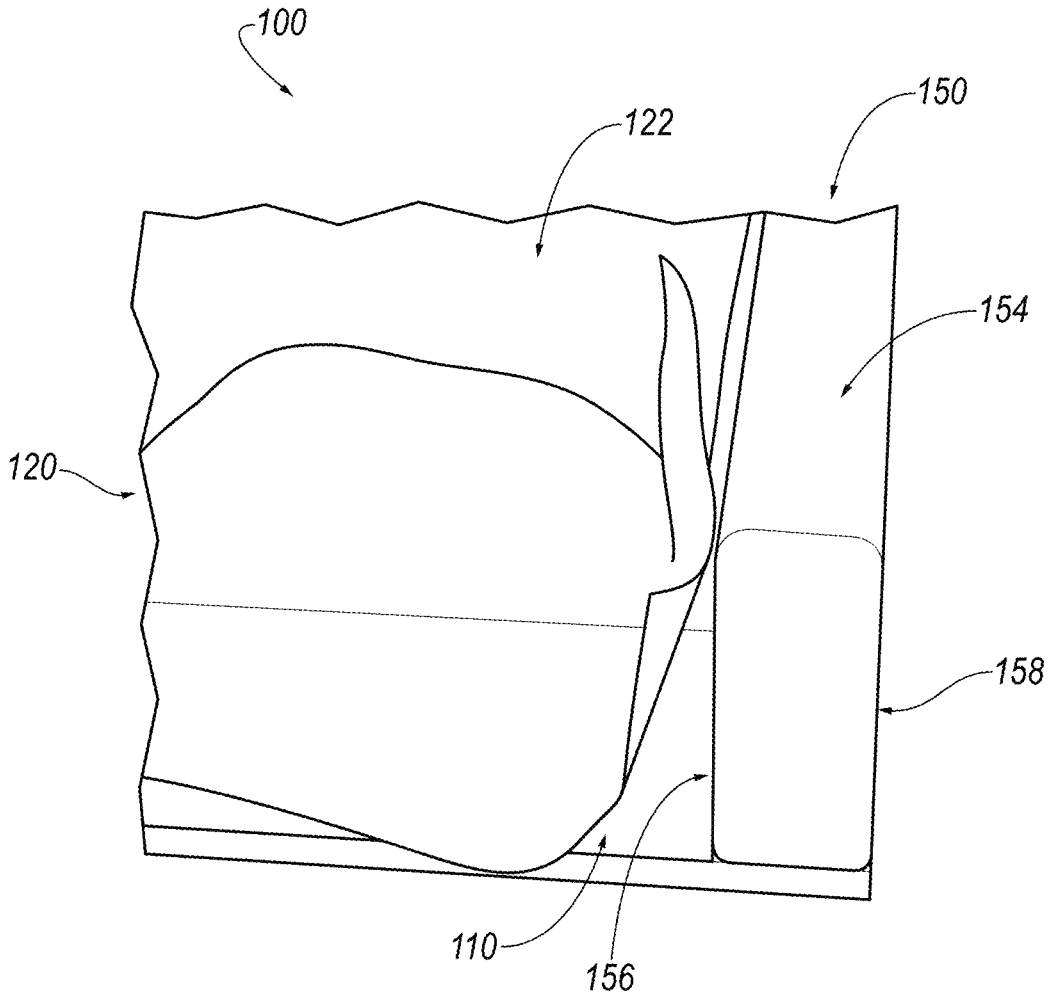

FIG. 4E depicts a corner of the waterproof membrane 120. In one example, the corner 300 has been cut (e.g., cut perpendicular to the length of the curb 150) such that it may be folded to provide a waterproof barrier at an intersection of two or more planes of the waterproof membrane 120. Generally, when an installer installs a waterproof liner on the job site, the installer often is stuck folding the waterproof liner in corners although it may cause bulges and thickness inconsistencies for when the installer tiles the shower area. Instead of having to worry about these folds, the waterproof membrane 120 is cut and folded off-site to tightly conform to the shape of the shower base 100 while maintaining leak-proof standards.

Figure 4F:
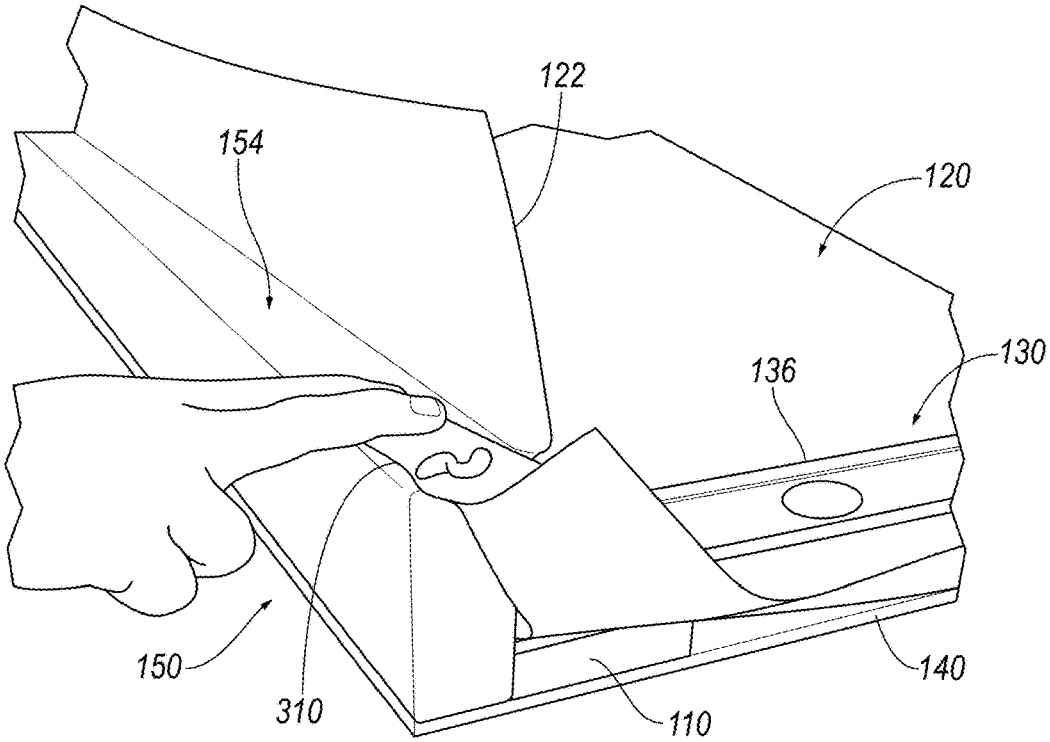

With the cut as shown in FIG. 4E, FIG. 4F illustrates the cut corner 300 of the waterproof membrane 120 being folded to form the tab 310 before the overhang portion 122 wraps around the curb 150 on top of the tab 310. In FIG. 4F, the operator is holding down the tab 310 against the top surface 154 of the curb 150. By holding the tab 310, the operator may ensure the tab 310 stays flat against the top surface 154 when the waterproof membrane 120 continues to wrap around the curb 150 and the tab 310 (e.g., in the fold over direction indicated by the arrow). Here, the waterproof sealant/adhesive (e.g., the caulk) is shown being applied to the tab 310 at a location where an edge of the overhang portion 122 of the waterproof membrane 120 will wrap around the curb 150 (e.g., at an end of the top surface 154). By using additional waterproof sealant/adhesive here, the operator forms a waterproof interface between the overhang portion 122 of the waterproof membrane 120 and the tab 310.

Figure 4G:
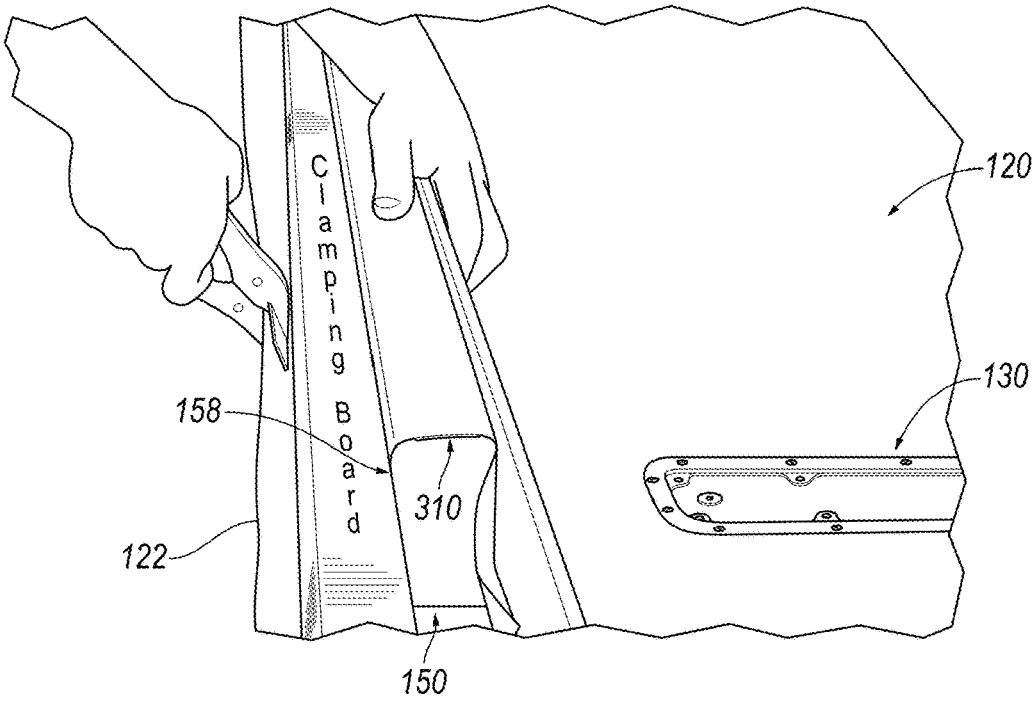

FIG. 4G is an example of the waterproof membrane 120 being secured/adhered to the second side 158 of the curb 150 (e.g., shown with a clamping board). Here, like the clamping bar of FIG. 4C, the clamping board ensures an even distribution of force (e.g., clamping force) along the length of the curb 150 to adhere the waterproof membrane 120 to the second side 158 of the curb 150. In some examples, as shown in FIG. 4G, part of the overhang portion 122 of the waterproof membrane 120 that extends beyond a surface area of the second side 158 is shown being pulled underneath the clamping board. For instance, FIG. 4G depicts an operator pulling the overhang portion 122 underneath the clamping board (or between two clamping boards).

Figure 4H:
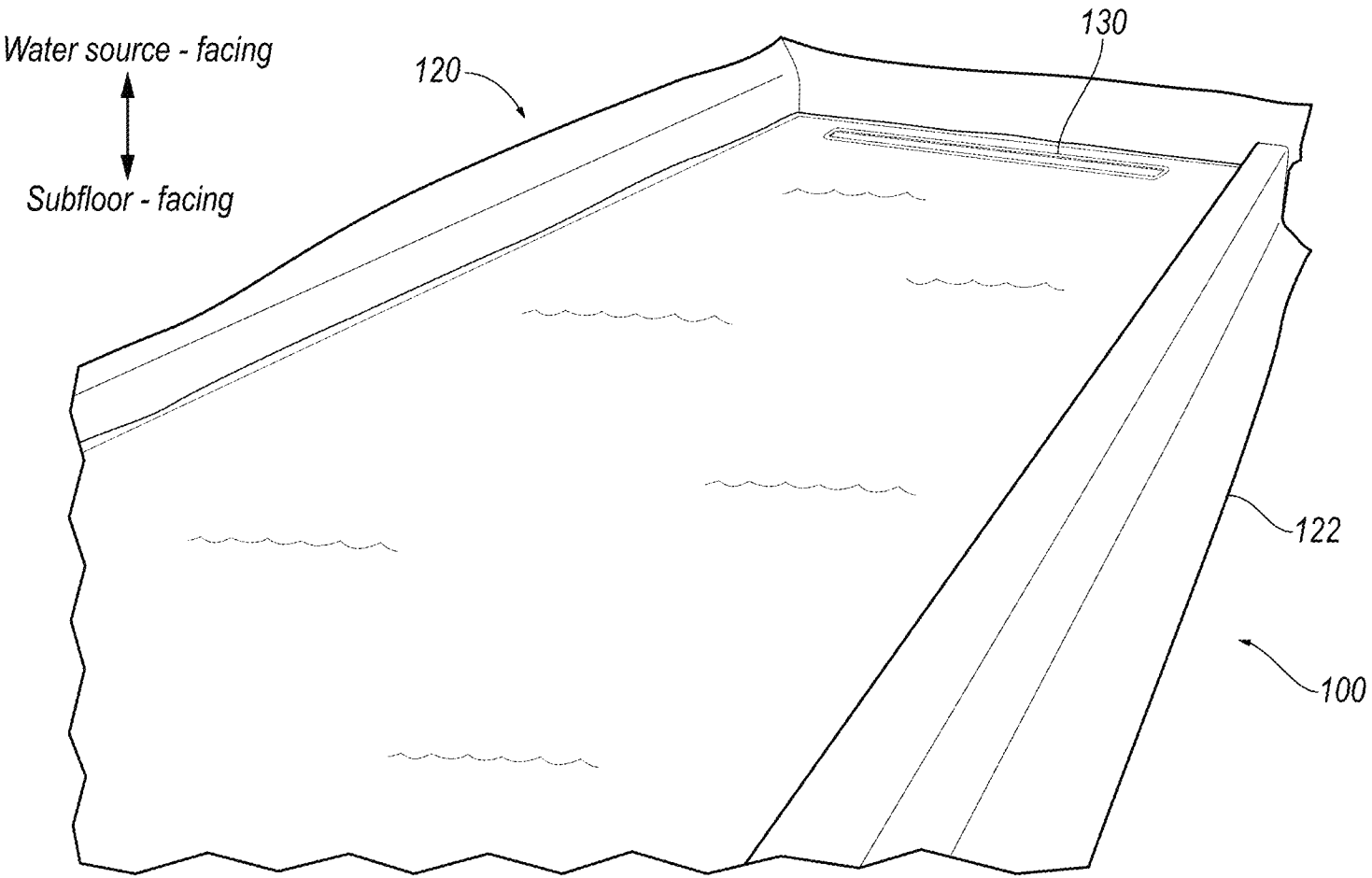

FIG. 4H is an example of a water test being performed on the shower base 100 at a location remote from the job-site (i.e., the job-site is the location where the shower base 100 will be installed). In one example, prior to water-testing, remaining overhang portions 122 are clamped in place and/or the drain 130 is plugged. During the water test, the shower base 100 may be filled with water such that the entire water source-facing surface of the shower base 100 is submerged under water. In some examples, where the curb 150 does not entirely surround the shower base 100, the waterproof membrane 120 may be clamped to a board or other rigid membrane to simulate a vertical surface (e.g., such as a backer board 12 or framing structure 14) such that the water is contained within a basin of the shower base 100 like it will be in the shower area after install on-site. Although not shown, the waterproof membrane 120 may be creased, trimmed, and/or cut to perform the discussed folds at any time prior to its direct adhesion to the shower base 100. This may include cutting the waterproof membrane 120 in a sheet form with the corners 300 prior to any adhesion to the spacer layer 110 and/or the curb 150 of the shower base 100.

Figure 5:
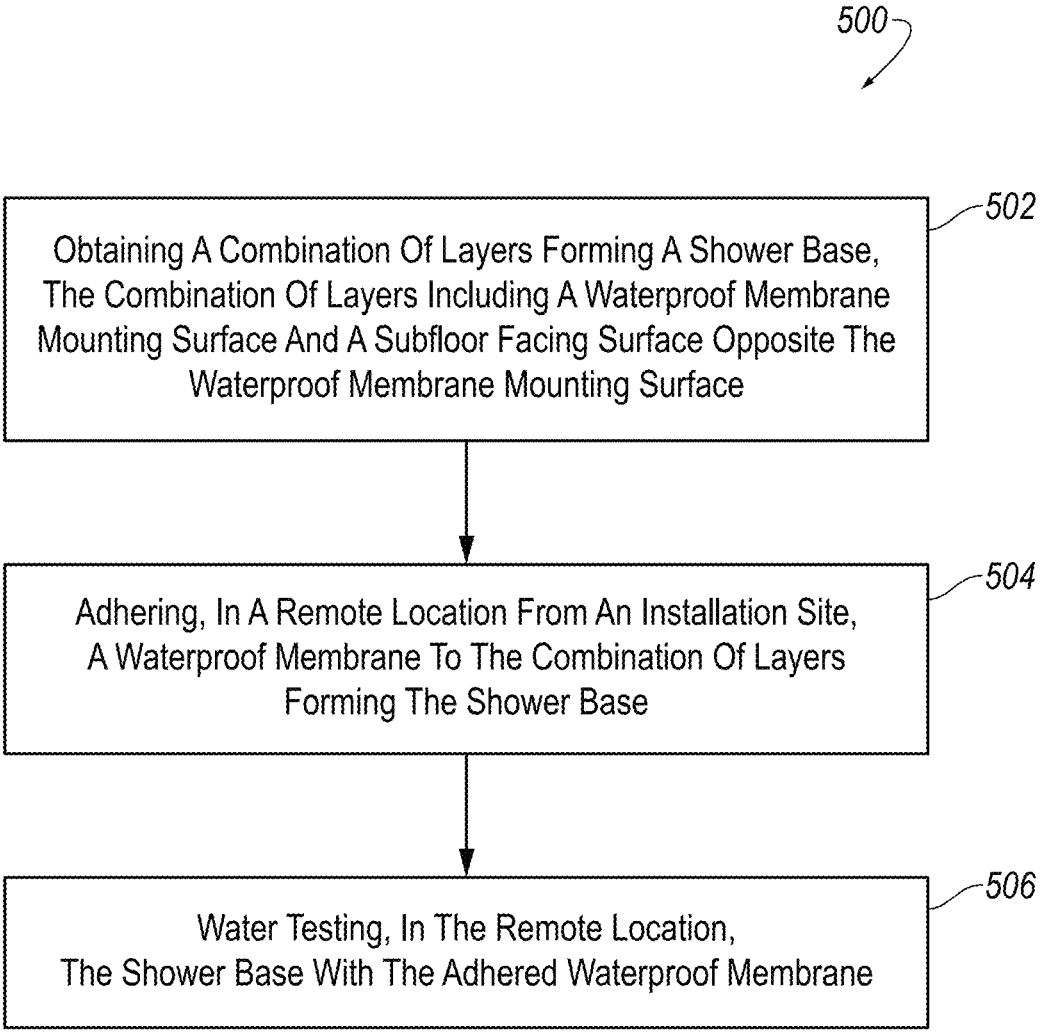
FIG. 5 is an example arrangement of operations to form the assembled shower base.

FIG. 5 depicts an arrangement of operations 502-506 that may be performed to assemble the shower base 100 (e.g., in an off-site location). In operation 502, the method 500 obtains a combination of layers (e.g., layers 110 and/or 140) forming a shower base 100. The combination of layers includes a waterproof membrane-mounting surface and a subfloor-facing surface opposite the waterproof membrane mounting surface. At operation 504, the method 500 adheres, in a remote location from an installation site, a waterproof membrane 120 to the combination of layers forming the shower base 100. At operations 506, the method 500 water tests, in the remote location, the shower base 100 with the adhered waterproof membrane 120.

Another example is a method of installing of the shower base 100. In this method, the shower base 100 (with the spacer layer 110, the membrane 120, and one or more curbs 150) is adhered to the subfloor 16 in the shower area at a job-site. In some examples, the shower base 100 includes the backer layer 140 and the backer layer 140 is the layer that an installer adheres to the subfloor 16. In another embodiment, the shower base 100 does not include the backer layer 140 and it is the spacer layer 110 that is adhered to the subfloor 16. In some configurations, prior to the shower base 100 being adhered to the subfloor 16, the drain 130 of the shower base 100 is connected to a plumbing pipe extending through the subfloor 16 (e.g., using the drain adapter 160). Here, once the drain 130 is connected to the plumbing pipe, the shower base 100 is secured (e.g., adhered) to the subfloor 16. In some configurations, the overhanging portions 122 of the membrane 120 are secured to (e.g., adhered to or tacked to) either the backer board 12 or the framing structure 14 in the shower area. In these configurations, once the overhanging portions 122 of the membrane 120 are secured, the shower base 100 may receive a tile or stone layer on top of the membrane 120. Optionally, the tile or stone layer is attached on top of the membrane 120 of the shower base 100 before the shower base 100 is adhered to the subfloor 16 in the shower area at a job-site.

Generally speaking, the waterproof membrane 120 may be secured to the spacer layer 110 (e.g., it is adhered to the spacer layer 110). Yet by having one or more overhanging portions 122, a portion of the waterproof membrane 120 (e.g., a secured portion 128 as shown in FIGS. 6A-6D) is secured to the spacer layer 110 (e.g., a water-facing surface of the spacer layer 110) and a portion of the waterproof membrane 120 is unsecured to the spacer layer 110 (e.g., the overhanging portions 122). More specifically, the overhanging portion 122 occurs at a periphery of the waterproof membrane 120 such that the one or more overhanging portion 122 can be folded or formed to extend in a direction different from the secured portion 128 of the waterproof member 120. For example, generally the waterproof membrane 120 is secured atop the spacer layer 110 assuming a pitch or a slope of the spacer layer 110 with respect to the generally horizontal subfloor 16. Even with these one or more slopes, the waterproof membrane 120 is relatively horizontal such that the waterproof membrane 110 has a slope (e.g., grade) less than 10% (e.g., 2%). Therefore, the secured portion 128 of the waterproof membrane 120 that secures to the spacer layer 110 extends in a first direction at this generally horizontal slope while the overhanging portion 122 or unsecured portion at the periphery of the waterproof membrane 120 is able to upturn in a second direction. In some examples, the second direction corresponds to a vertical direction where the overhanging portions 122 are able to extend along a vertical surface, such as a wall (e.g., the backer board 12 or the framing structure 14 in the shower area) or a vertical surface of the curb 150 (e.g., an outer vertical surface of the curb 150 that faces away from the drain. By having both secured (e.g., the secured portion 128) and unsecured portions (e.g., the overhanging portion 122) of the waterproof membrane 120, the shower base 100 is able to be water-tested (e.g., as shown in FIG. 4I) off-site, but then have its unsecured portions secured on-site without an on-site worker having to add any additional material to the shower base 100 in order to secure the shower base 100 to vertical walls during on-site installation (e.g., extra water proof flashing). As discussed previously, an "off-site location" (also referred to as a remote location) refers to a location other than where the shower base 100 will be permanently affixed to a subfloor 16 to form a usable shower area while an "on-site location" is the location where the shower base 100 will be permanently affixed to the subfloor 16 to form the usable shower area (i.e., secured to plumbing for water drainage as well as bonded to the subfloor 16).

Figure 6A:
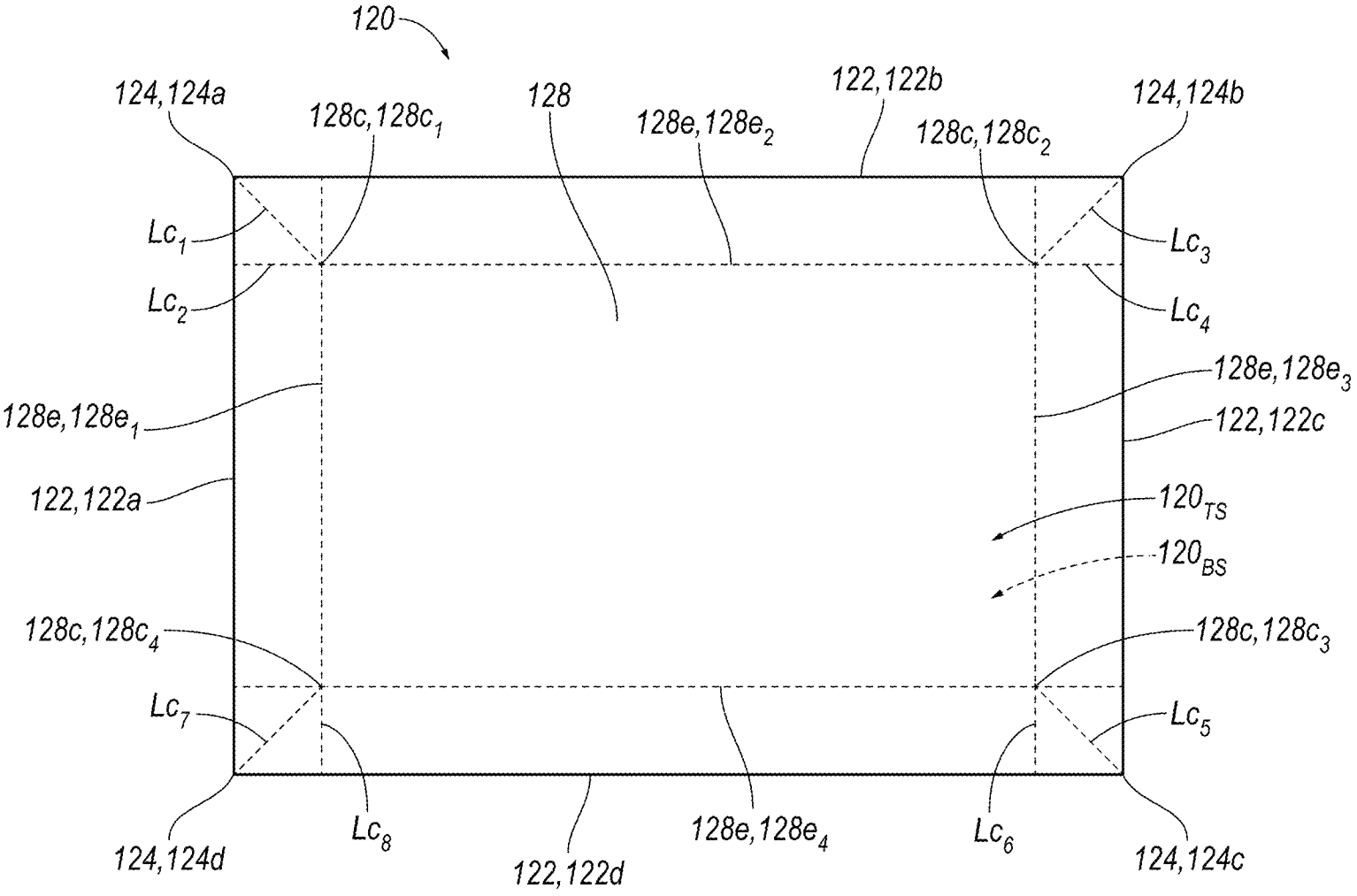
FIGS. 6A and 6B are perspective views of example folding techniques for a waterproof membrane.
Figure 6B:
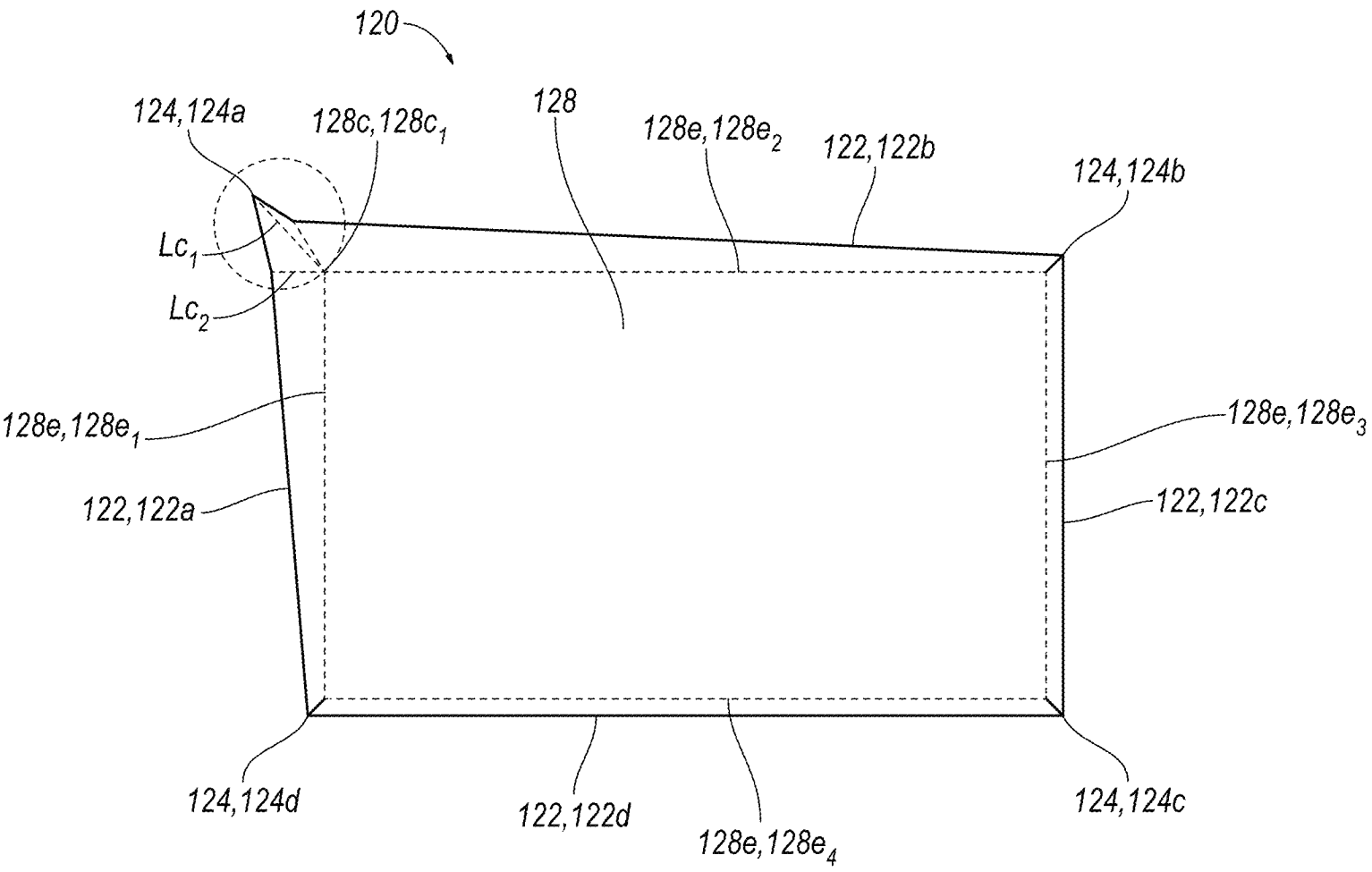
Figure 6C:
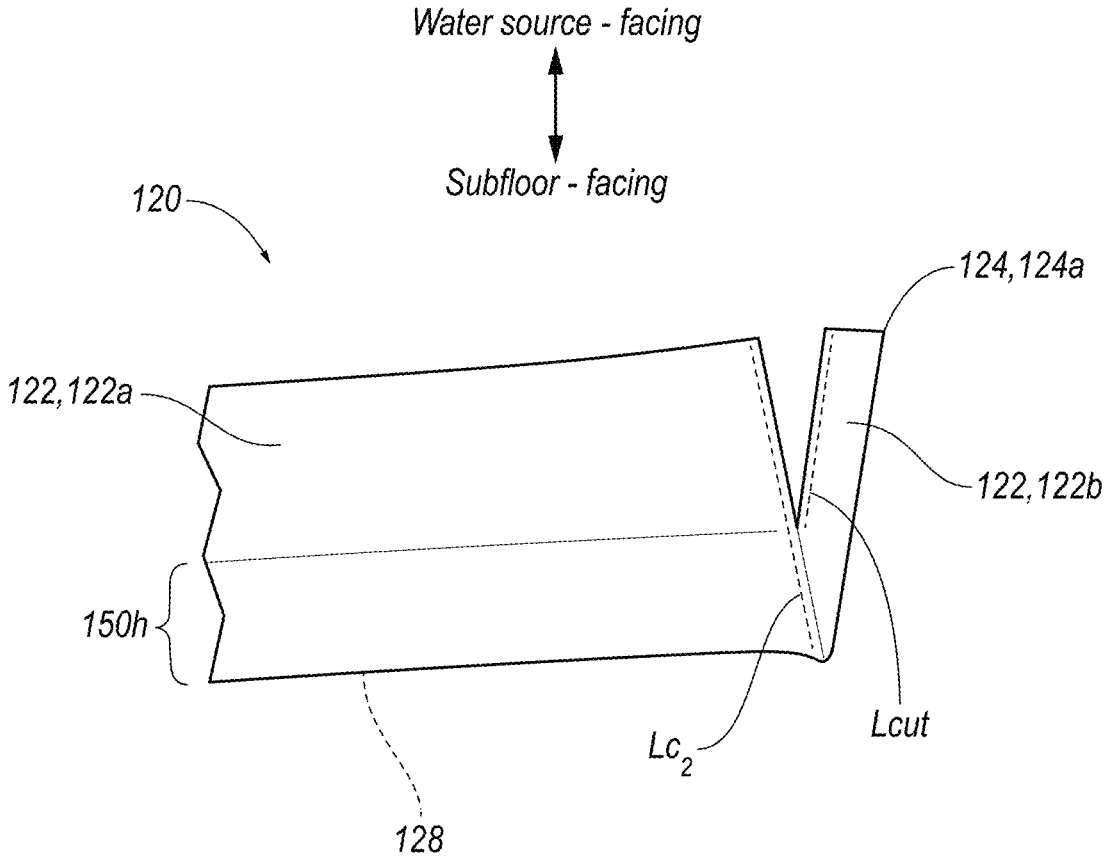
FIGS. 6C-6E are perspective views of example curb wrapping techniques for a waterproof membrane.
Figure 6D:
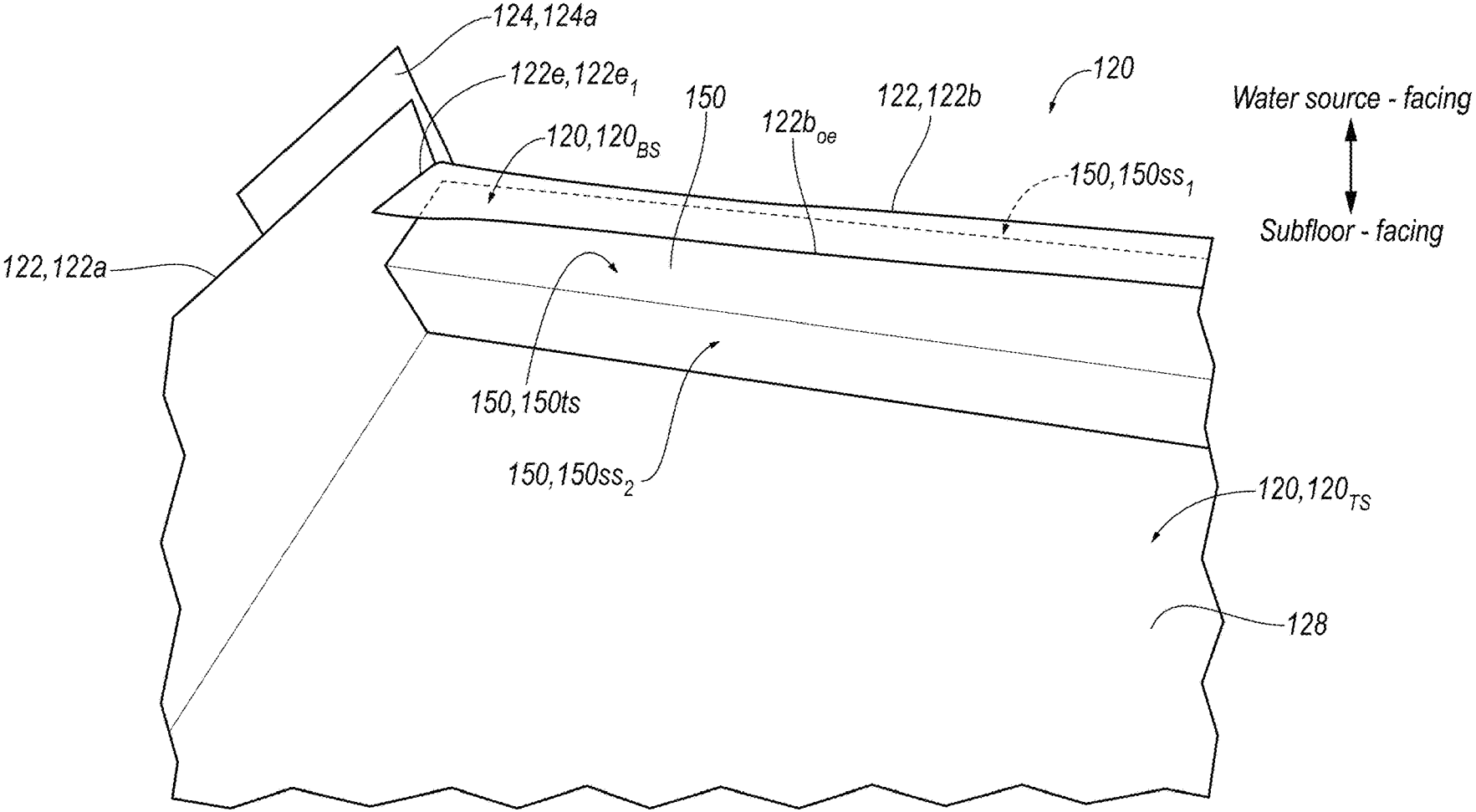
Figure 6E:
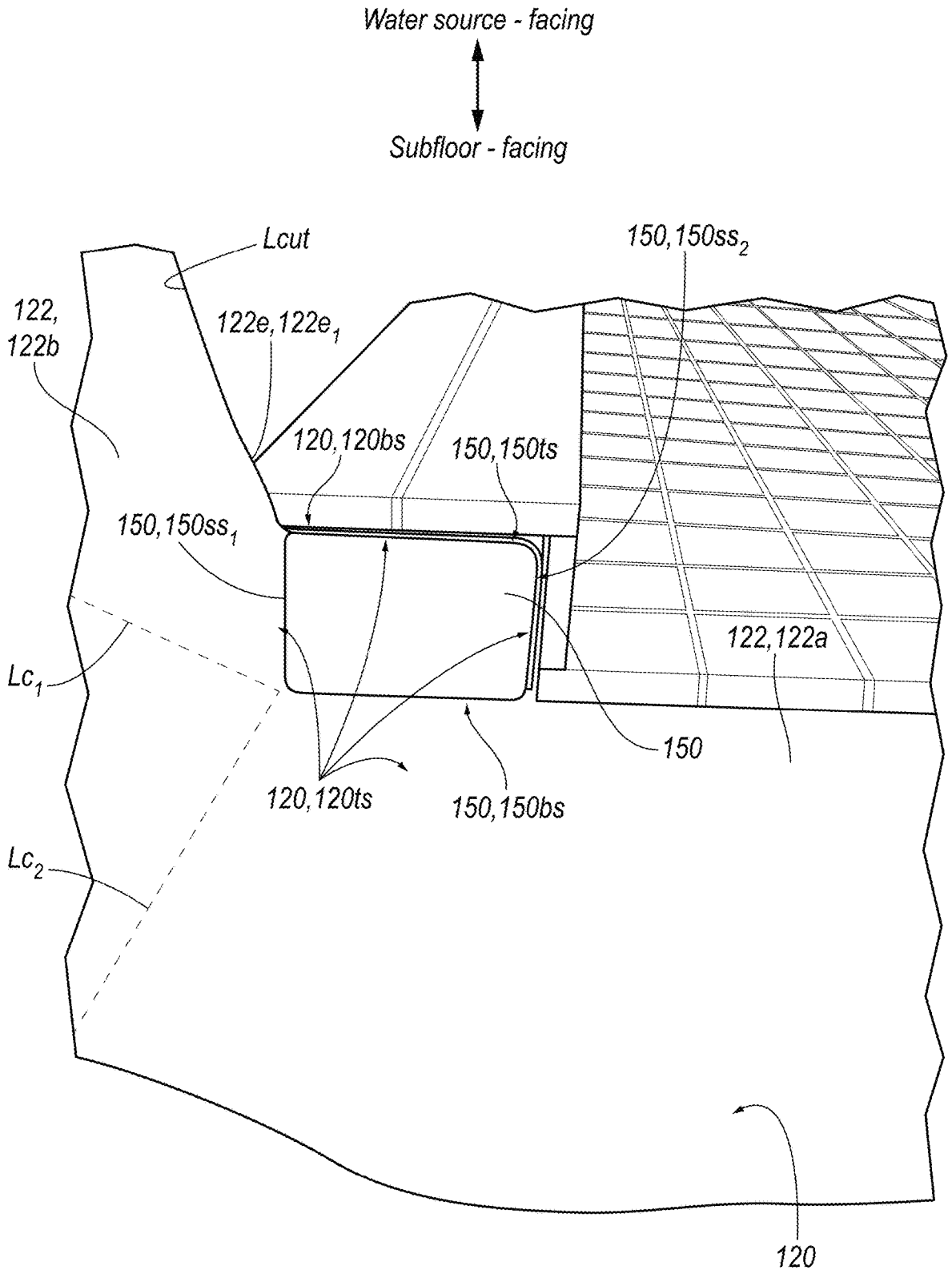

FIGS. 6A and 6B are examples of an alternative folding pattern for the waterproof membrane 120 (e.g., a folded corner or a tucked corner); while FIGS. 6C-6E depict a membrane wrapping technique that may be used in conjunction with the alternative folding pattern of FIGS. 6A and 6B or with other folding patterns for the waterproof membrane 120. For example, FIG. 6A depicts a continuous sheet of the waterproof membrane 120 with the waterproof membrane 120 having a bottom, subfloor facing surface $\mathbf{120}_{BS}$ and a top, water-source facing surface $\mathbf{120}_{TS}$. The continuous sheet of the waterproof membrane 120 also has corners 124, 124*a-d* that have been creased along a first set of diagonal crease lines $Lc_{1,3,5,7}$ extending from secured portion 128 (e.g., shown with a dotted boundary box) to an apex of each corner 124, 124*a-d*. In this example, the membrane 120 also includes four overhanging portions 122, 122*a-d* at the periphery of the secured portion 128 of the membrane 120. Referring to FIG. 6A, for example, a first overhanging portion 122*a* extends along the left edge 128*e*, $\mathbf{128}e_1$ of the secure portion 128, a second overhanging portion 122*b* extends along the top edge 128*e*, $\mathbf{128}e_2$ of the secure portion 128, a third overhanging portion 122*c* extends along the right edge 128*e*, $\mathbf{128}e_3$ of the secure portion 128, and a fourth overhanging portion 122*d* extends along the bottom edge 128*e*, $\mathbf{128}e_4$ of the secure portion 128. Each overhanging portion 122 has a generally rectangular shape that is independent (i.e., referred to as "an independent portion") of other overhanging portions 122, but shares a corner 124 with an adjacent overhanging portion 122. For example, the first overhanging portion 122*a* extends vertically along the first edge $\mathbf{128}e_1$ of the secured portion 128 and, in the first corner 124*a*, meets the second overhanging portion 122*b* extending horizontally along the second edge $\mathbf{128}e_2$ of the secured portion 128. The shared area between the first overhanging portion 122*a* and the second overhanging portion 122*b* extends from an edge of an independent portion of an overhanging portion 122 to the corner 124 and is generally rectangular in shape bisected by the diagonal crease line Lc (e.g., the first crease line $L_{C1}$ diagonally bisects the shared corner between the first overhanging portion 122*a* and the second overhanging portion 122*b*).

The two overhanging portions 122*a-b* which are perpendicular to each other are upturned (i.e., each is folded from a flat or horizontal position to a vertical position) and the corner 124*a* adjoining the two overhanging portions 122*a-b* is folded along the first crease line $Lc_1$. By folding the corner 124*a* along the first crease line $Lc_1$, a triangular overhanging portion is formed by the corner 124*a*. In some examples, when forming the triangular overhanging portion, the two overhanging portions 122*a-b* are folded along the first crease line $L_{c1}$ such that portions of the top surface $\mathbf{120}_{TS}$ (i.e., the water-facing surface of the membrane 120) on each side of the first crease line $L_{c1}$ mate. Here, folding along the crease line $L_{c1}$ by mating portions of the top surface $\mathbf{120}_{TS}$ of the membrane 120 on each side of the first crease line $L_{c1}$ together maintains a slope for the triangular overhanging portion that drains water along the first crease line $Lc_1$ to the upturn pan rather than outside of the upturn pan (e.g., potentially causing water damage to the shower area/subfloor around the shower area).

The triangular overhanging portion is subsequently folded along a second crease line $Lc_2$ that is located at an edge of an independent portion of the first overhanging portion 122*a*. Stated differently (as shown in FIG. 6A), the second crease line $Lc_2$ is an extension of an edge 128*e* (e.g., shown as a second edge 128*e*, $\mathbf{128}e_2$) of the secured portion 128 from a junction 128*c* (e.g., shown as a first junction 128*c*, $\mathbf{128}c_1$) of the secured portion 128 to the outer boundary of the waterproof membrane 120. As such, the triangular overhanging portion can tuck behind the first overhanging portion 122*a* and secure to the subfloor-facing surface of the first overhanging portion 122*a* of the waterproof membrane 120. In some examples, instead of tucking behind or securing to an overhanging portion 122, the triangular overhanging portion may be secured to the framing structure 14 (e.g., a face of a framing stud or wrapping underneath a framing stud). When this folding pattern is repeated along a first set of diagonal crease lines $Lc_{1,3,5,7}$ and a second set of diagonal crease lines $Lc_{2,4,6,8}$, the folded membrane 120 results in a vertical upturned pan shape (e.g., the base of the pan is the secured portion 128 with a vertical perimeter wall formed from unsecured portions 122). For instance, FIG. 6B depicts that three of the four triangular overhanging portions have been secured while the fourth triangular overhanging portions (circled) has yet to be folded behind the first or second overhanding portion 122*a-b*.

Referring to FIGS. 6C-6E, one of the overhanging portions 122 can be wrapped over the curb 150 (e.g., as shown in FIGS. 6D and 6E) towards the secured portion 128 of the membrane 120 to form a "membrane over curb" wrapping technique. In this membrane over curb wrapping technique, the curb 150 is positioned such that a bottom surface 150, 150*bs* of the curb 150 is placed on the top, water-source facing surface $\mathbf{120}_{TS}$ of the membrane 120. In some examples, when two of the overlapping portions 122*a-b* have been upturned to a vertical position to form a right angle in the corner 124, 124*a*, the membrane 120 may be cut along a cut line Lcut (e.g., along the second crease line $Lc_2$). Here, the membrane 120 is cut along the cut line Lcut in the corner 124*a* to about the height 150*h* of the curb 150 (e.g., as shown in FIG. 6C). By cutting the membrane 120 along the cut line Lcut to a height 150*h* of the curb 150, one of the overhanging portions 122 (e.g., shown in FIG. 6D as the overhanging portion 122*b*) adjacent to the cut line Lcut can be wrapped over the curb 150 (e.g., as shown in FIGS. 6D and 6E) towards the secured portion 128 of the membrane 120. For instance, the overhanging portion 122 is wrapped around the curb 150 to cover a first side surface 150*ss*, $\mathbf{150}ss_1$ of the curb 150 that faces away from the secured portion 128 (i.e., inside the upturned pan), a top surface 150*ts*, and a second side surface 150*ss*, $\mathbf{150}ss_2$ of the curb that faces the secured portion 128 (i.e., faces the water receiving area of the upturn pan opposite the first side surface 150*ss*).

In some implementations, an overhanging portion 122 may be wrapped over a curb 150 before folding the corner 124 where two overhanging portions 122*b* meet (e.g., according to the folding technique shown in FIGS. 6A and 6B). For instance, similar to an approach where the membrane over curb wrapping technique occurs after the folding process, the curb 150 is placed on an edge of the secured portion 128 (e.g., the first edge 128*e*, 128$e_1$). When wrapping the membrane 120 over the curb 150 prior to the folding process, an overhanging portion 122*a* (e.g., adjacent to the edge 128 where the curb 150 is located) is wrapped around the curb 150 towards the secured portion 128. For instance, the overhanging portion 122 is wrapped around the curb 150 to cover the first side surface 150$ss_1$ of the curb 150, the top surface 150*ts* of the curb 150, and the second side surface 150$ss_2$ of the curb 150. Once wrapped over the curb 150, the membrane 120 may be cut along the cut line Lcut at an end of the curb 150 (e.g., cut at the crease line $L_{c2}$ as shown in FIG. 6A). For instance, the cut line Lcut has a length that leaves a portion of the overhanging portion 122 intact (i.e., uncut) that is roughly the height 150*h* of the curb 150 (e.g., as shown in FIG. 6C).

Furthermore, by cutting the membrane 120 at the corner 124*a*, when the membrane 120 is wrapped around the corner 124, the membrane 120 is able to maintain contact or abutment with the first overhanging portion 122*a*. In other words, referring to the example of FIG. 6D, an edge (e.g., labeled as a first edge 122*e*, 122$e_1$) of the independent portion of the second overhanging portion 122*b* folds around the curb 150 by pivoting about an end point of the cut line Lcut and maintaining contact at its edge (e.g., the first edge 122$e_1$) with the water-facing surface of the first overhanging portion 122*a* as the second overhanging portion 122*b* wraps around one or more surfaces of the curb 150 (e.g., shown wrapping around a top surface 150, 150*ts* of the curb 150). This abutment/contact may allow a physical seal for water tightness to reduce or to prevent possible leaks during use of the shower base 100. Although FIG. 6D illustrates the membrane 120 only partially wrapping around the curb 150, this is to view the placement of the curb 150 on top of the top surface 120$_{TS}$ of the membrane 120.

FIG. 6E is an example depicting that the overhanging portion 122*b* wraps entirely around the curb 150. That is, for instance, the second overhanging portion 122*b* is wrapped around (or covers) the top surface 150*ts* of the curb 150 and each side surface 150, 150*ss* of the curb 150 such that the outer edge 122$b_{oe}$ of the second overhanging portion 122*b* is brought into contact/secured to the secured portion 128 of the membrane 120 (e.g., as the first edge 122$e_1$ maintains contact with the water-facing surface of the first overhanging portion 122*a*). Glue or some other bonding agent may be applied to the curb 150 (e.g., each side surface 150*ss* and/or the top surface 150*ts*) prior to wrapping the overhanging portion 122 for securement. Additionally or alternatively, sealant or some form of bonding agent may be applied to the folds or for reinforcement in the corners 124 to aid with leak-proofing. By using this corner folding technique (FIGS. 6A-6B) with the curb wrapping process (FIGS. 6C-6E), the curb 150 may be entirely secured to the membrane 120 (i.e., without direct contact to any other portion of the shower base 100). In some configurations, the shower base assembly uses this technique to secure more than one curb 150 to the shower base 100. In some implementations, the shower base 100 may be formed using a hybrid of the folding techniques shown in FIGS. 3A-3D and the folding techniques shown in FIGS. 6A and 6B. For example, the folding technique of FIGS. 3A-3D is performed on a first corner and the folding technique of FIGS. 6A and 6B is performed on a second corner that is different from the first corner.

A number of implementations have been described. Nevertheless, it will be understood that various modifications may be made without departing from the spirit and scope of the disclosure. Accordingly, other implementations are within the scope of the following claims.

What is claimed is:

1. A system comprising:

a drain including a top surface, a bottom surface, a drain hole, and a cavity formed in the bottom surface and surrounding the drain hole; and a rotatable drain adapter disposed within the cavity, wherein the rotatable drain adapter includes an eccentric opening, and wherein a center point of the eccentric opening of the rotatable drain adapter is offset from a respective center point of the drain hole of the drain.

2. The system of claim 1, wherein the rotatable drain adapter is configured to rotate within the cavity to a position that aligns with a plumbing connection for the drain.

3. The system of claim 1, wherein the top surface of the drain includes a plurality of sloped surfaces that converge towards the drain hole.

4. The system of claim 1, wherein the rotatable drain adapter is configured to rotate between a set of adapter increment positions such that, for each adapter increment position, the center point of the rotatable drain adapter is offset from the respective center point of the drain hole of the drain a predetermined offset distance.

5. The system of claim 4, wherein the predetermined offset distance is a selected from a group consisting of ⅛", ¼", and ⅜".

6. The system of claim 1, wherein the eccentric opening of the rotatable drain adapter is one of a plurality of eccentric openings for the rotatable drain adapter.

7. The system of claim 1, wherein the drain is a rectangular prism.

8. The system of claim 1, wherein:

the drain includes a recess in the top surface;

the recess configured to matingly receive a removable clamping member; and a depth of the recess is greater than or equal to a thickness of the removable clamping member.

9. The system of claim 8, wherein a top surface of the removable clamping member is flush with the top surface of the drain.

10. The system of claim 8, wherein the top surface of the drain includes a set of openings configured to receive fasteners to secure the removable clamping member to the drain.

11. The system of claim 8, wherein the removable clamping member, when secured to the drain, forms a mechanical barrier that prevents water flowing through the drain hole from egressing an interface between the removable clamping member and the drain.

12. The system of claim 8, wherein the recess has a sloped wall sloping toward the drain hole.

13. The system of claim 8, wherein the top surface includes a non-recessed portion that forms one or more posts configured to receive a drain cover.

14. The system of claim 13, wherein the one or more posts at least partially form a boundary wall defining the recess.

15. The system of claim 13, further comprising the drain cover coaxially seated on the drain with respect to the removable clamping member.

16. The system of claim 1, wherein, when seated in the cavity, the rotatable drain adapter has a thickness that extends beyond the bottom surface of the drain.

17. The system of claim 1, wherein:

the cavity is defined by a peripheral wall and a cavity bottom surface that is parallel to the bottom surface of the drain; and the rotatable drain adapter is disposed within the cavity such that (i) a top surface of the rotatable drain adapter mates with the cavity bottom surface and (ii) the peripheral wall surrounds an outer surface of the rotatable drain adapter.

18. The system of claim 17, wherein a height of the peripheral wall is greater than or equal to a thickness of the rotatable drain adapter.

19. The system of claim 17, wherein the peripheral wall includes a lip that protrudes from the bottom surface of the drain.

20. The system of claim 19, wherein a bottom surface of the rotatable drain adapter opposite the top surface of the rotatable drain adapter is coplanar with a surface of the lip when the rotatable drain adapter is seated within the cavity.

21. The system of claim 1, wherein the cavity defines a first cross-sectional dimension, the rotatable drain adapter defines a second cross-sectional dimension, and the second cross-sectional dimension is smaller than the first cross-sectional dimension.

* * * * *